US008622512B2

(12) United States Patent
Inoue

(10) Patent No.: US 8,622,512 B2
(45) Date of Patent: Jan. 7, 2014

(54) DROPLET EJECTION APPARATUS

(75) Inventor: Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 114 days.

(21) Appl. No.: 13/073,464

(22) Filed: Mar. 28, 2011

(65) Prior Publication Data

US 2011/0234696 A1 Sep. 29, 2011

(30) Foreign Application Priority Data

Mar. 29, 2010 (JP) ..... 2010-075491

(51) Int. Cl.
*B41J 2/165* (2006.01)

(52) U.S. Cl.
USPC ..... 347/33; 347/22

(58) Field of Classification Search
USPC ..... 347/22, 33
See application file for complete search history.

(56) References Cited

U.S. PATENT DOCUMENTS

| | | | | |
|---|---|---|---|---|
| 6,164,754 | A * | 12/2000 | Ide et al. | 347/33 |
| 6,213,582 | B1 | 4/2001 | Uchida et al. | |
| 6,688,722 | B2 | 2/2004 | Uchida et al. | |
| 2004/0125189 | A1 | 7/2004 | Kuki et al. | |
| 2004/0227785 | A1 * | 11/2004 | Katsuta et al. | 347/33 |
| 2005/0007412 | A1 * | 1/2005 | Nishikawa et al. | 347/33 |

FOREIGN PATENT DOCUMENTS

| | | | |
|---|---|---|---|
| JP | 02088247 | A * | 3/1990 |
| JP | 3-262646 | A | 11/1991 |
| JP | 5-57894 | A | 3/1993 |
| JP | 2003-182088 | A | 7/2003 |
| JP | 2004-142450 | A | 5/2004 |
| JP | 2007-203679 | A | 8/2007 |
| JP | 2008-137266 | A | 6/2008 |
| JP | 2010-005856 | A | 1/2010 |

OTHER PUBLICATIONS

JP Office Action issued in corresponding JP Patent Application No. 2010-075491on May 23, 2013.

* cited by examiner

*Primary Examiner* — Matthew Luu
*Assistant Examiner* — Justin Seo
(74) *Attorney, Agent, or Firm* — Birch, Stewart, Kolasch & Birch, LLP

(57) ABSTRACT

A droplet ejection apparatus includes: a droplet ejection head which includes a nozzle surface having a non-nozzle forming region and a nozzle forming region of a prescribed width in a prescribed direction, a nozzle row being formed in the nozzle forming region; and a nozzle surface cleaning apparatus which cleans the nozzle surface of the droplet ejection head and includes: a wiping device which presses a wiping member having absorbency against the nozzle surface and wipes the nozzle surface with the wiping member by moving the wiping member relatively in the prescribed direction with respect to the nozzle surface; and a sweeping device which sweeps excess liquid from the non-nozzle forming region before the wiping member wipes the nozzle surface, by pressing a sweeping member having elasticity against the non-nozzle forming region and moving the sweeping member relatively in the prescribed direction with respect to the nozzle surface.

11 Claims, 16 Drawing Sheets

DROPLET EJECTION APPARATUS

BACKGROUND OF THE INVENTION

1. Field of the Invention

The present invention relates to a droplet ejection apparatus, and more particularly to a droplet ejection apparatus including a nozzle surface cleaning apparatus which wipes a nozzle surface with a wiping member having absorbency.

2. Description of the Related Art

When a recording operation is carried out continuously in an inkjet recording apparatus, ink adheres and accumulates in the vicinity of the nozzles and blockages occur in the nozzles. Hence, in an inkjet recording apparatus, cleaning of the nozzle surface is carried out periodically.

In general, the cleaning of the nozzle surface is performed by wiping the nozzle surface with a blade or ink absorbing body after subjecting the nozzle surface to a wet state.

Japanese Patent Application Publication No. 2004-142450 discloses a method of cleaning a nozzle surface in which a nozzle surface is wiped with a wiping member having absorbency after removing ink from the nozzle surface with a non-contact-type ink receiving member. However, this method has a drawback in that the ink on the nozzle surface cannot be removed completely because the ink receiving member does not make contact with the nozzle surface. In particular, if a liquid repelling treatment is not applied on the whole of the nozzle surface, then there is a drawback in that the liquid adhering to the portion where no liquid repelling treatment is applied cannot be removed (in the region not applied with a liquid repelling treatment, the angle of contact of the ink is small, the ink wets and spreads, and therefore the ink does not make contact with the non-contact ink receiving member and the ink cannot be removed). Therefore, a drawback arises in that, if the nozzle surface is subsequently wiped with a wiping member having absorbency, the wiping member absorbs an excessive amount of ink, the absorption capability of the wiping member declines, and wiping residue occurs.

Japanese Patent Application Publication No. 03-262646 discloses a method in which a nozzle arrangement region is swept with a first cleaning member constituted of a blade member and the periphery of the nozzle arrangement region is swept with a second cleaning member constituted of a blade member. However, if the nozzle surface is swept with the blade member having no absorbency, then soiled ink is pressed inside the nozzles, and hence there is a drawback in that preliminary ejection must be performed after sweeping. Furthermore, if a liquid repelling treatment is applied on the nozzle surface, then there is a drawback in that the liquid repelling treatment surface is rubbed by the blade member and becomes worn.

SUMMARY OF THE INVENTION

The present invention has been contrived in view of these circumstances, an object thereof being to provide a droplet ejection apparatus capable of reliably wiping a nozzle surface by preventing liquid from being pushed inside nozzles during wiping of the nozzle surface.

In order to attain the aforementioned object, the present invention is directed to a droplet ejection apparatus, comprising: a droplet ejection head which includes a nozzle surface having a non-nozzle forming region and a nozzle forming region of a prescribed width in a prescribed direction, a nozzle row being formed in the nozzle forming region; and a nozzle surface cleaning apparatus which cleans the nozzle surface of the droplet ejection head, the nozzle surface cleaning apparatus including: a wiping device which presses a wiping member having absorbency against the nozzle surface and wipes the nozzle surface with the wiping member by moving the wiping member relatively in the prescribed direction with respect to the nozzle surface; and a sweeping device which sweeps excess liquid from the non-nozzle forming region before the wiping member wipes the nozzle surface, by pressing a sweeping member having elasticity against the non-nozzle forming region and moving the sweeping member relatively in the prescribed direction with respect to the nozzle surface.

According to this aspect of the present invention, excess liquid adhering to the non-nozzle forming region other than the nozzle forming region is swept by pressing the sweeping member having flexibility against the non-nozzle forming region and moving the sweeping member relatively with respect to the nozzle surface, before wiping the nozzle surface with the wiping member having absorbency. Thus, it is possible to prevent the excessive liquid being absorbed by the wiping member, leading to decline in the absorption capability of the wiping member and the occurrence of wiping residue. Furthermore, since the sweeping device is pressed against the nozzle surface, then it is possible to remove the excess liquid suitably, even if no liquid repelling treatment is applied on the nozzle surface. On the other hand, since the sweeping member is pressed against the non-nozzle forming region other than the nozzle forming region, then it is possible to prevent liquid from being pushing inside the nozzles.

Preferably, the nozzle surface is applied with a liquid repelling treatment only on the nozzle forming region.

According to this aspect of the present invention, the liquid repelling treatment is applied only on the nozzle forming region of the nozzle surface. Thus, it is possible to suppress costs. On the other hand, the excess liquid is swept with the sweeping device from the non-nozzle forming region where no liquid repelling treatment is applied, and therefore it is possible to clean the nozzle surface reliably without the occurrence of wiping residue. Moreover, since the sweeping member is not pressed against the nozzle forming region where the liquid repelling treatment is applied, then it is possible to prevent wear of the liquid repelling treatment surface.

Preferably, the nozzle forming region of the nozzle surface is formed in a recessed shape with respect to the other region.

According to this aspect of the present invention, the nozzle forming region of the nozzle surface is formed in the recessed shape with respect to the other regions. Thus, it is possible to protect the nozzle forming region in which the nozzles are formed.

Preferably, a region of the wiping member corresponding to the nozzle forming region is formed in a projecting shape in accordance with a cross-sectional shape of the nozzle surface.

According to this aspect of the present invention, the region corresponding to the nozzle forming region of the wiping member is formed in the projecting shape in accordance with the cross-sectional shape of the nozzle surface. Thus, it is possible to press the wiping member suitably against the nozzle surface, and the nozzle surface can be cleaned reliably.

Preferably, the nozzle surface of the droplet ejection head is inclined with respect to a horizontal plane; the non-nozzle forming region is disposed to a lower side of the nozzle surface in terms of a direction of inclination of the nozzle surface; and the sweeping device presses the sweeping member against the non-nozzle forming region disposed to the lower side of the nozzle surface.

According to this aspect of the present invention, the nozzle surface is inclined with respect to the horizontal plane, and the non-nozzle forming region other than the nozzle forming region is arranged to the lower side in terms of the direction of inclination. The sweeping member is pressed against the non-nozzle forming region which is disposed to the lower side of the nozzle surface in terms of the direction of inclination. If the nozzle surface is inclined, then the liquid flows over the nozzle surface due to its own weight and collects at the lower side in the direction of inclination, and therefore it is possible to remove the excess liquid efficiently by pressing the sweeping member against the region on the lower side in the direction of inclination.

Preferably, the wiping device includes: a wiping device main body; a supply spindle which is arranged on the wiping device main body; a take-up spindle which is arranged on the wiping device main body; a rotation drive device which drives the take-up spindle to rotate; the wiping member which is band-shaped and wound in a form of a roll installed on the supply spindle, the wiping member traveling along a prescribed path of travel from the supply spindle and being taken up onto the take-up spindle; and a pressing roller which is arranged on the wiping device main body, the wiping member being wrapped about a circumferential surface of the pressing roller, wherein the wiping device presses the wiping member being wrapped about the circumferential surface of the pressing roller against the nozzle surface.

According to this aspect of the present invention, the nozzle surface is wiped by causing the band-shaped wiping member to travel in one direction and pressing the wiping member against the nozzle surface by means of the pressing roller. Thus, the wiping position of the wiping member is changed progressively, and the nozzle surface can be wiped efficiently.

Preferably, the sweeping device includes: the sweeping member which is arranged on the wiping device main body of the wiping device; a flow channel which is arranged in the wiping device main body of the wiping device and recovers the liquid swept with the sweeping member; and a waste liquid tank into which the liquid flowing in the flow channel is discarded.

According to this aspect of the present invention, the sweeping member is installed integrally with the wiping device. Consequently, the composition can be made more compact.

Preferably, the droplet ejection head includes a line head having a length corresponding to a width of a medium; the nozzle forming region having the prescribed width is arranged along a lengthwise direction of the line head; and the nozzle row is aligned in the lengthwise direction.

According to this aspect of the present invention, the droplet ejection head is constituted of the line head having the length corresponding to the width of the medium. The nozzle forming region having the prescribed width is formed along the lengthwise direction of the line head and the nozzle row is aligned in the lengthwise direction in the nozzle forming region. By moving the sweeping device and the wiping device relatively in the lengthwise direction with respect to the line head, so as to sweep and wipe away the excess liquid, it is possible to clean the nozzle surface of the line head efficiently.

Preferably, the droplet ejection head is arranged movably in the lengthwise direction; and the excess liquid adhering to the non-nozzle forming region is swept with the sweeping member and the nozzle surface is wiped with the wiping member, by moving the droplet ejection head.

According to this aspect of the present invention, the excess liquid is swept and wiped away by moving the droplet ejection head. Thus, a separate mechanism for moving the sweeping device and the wiping device is not necessary, and the composition can be simplified.

Preferably, the droplet ejection apparatus further comprises a cleaning liquid deposition device which deposits cleaning liquid onto the nozzle surface while moving relatively in the prescribed direction with respect to the nozzle surface.

According to this aspect of the present invention, the cleaning liquid deposition device which deposits the cleaning liquid onto the nozzle surface is arranged. Thereby, it is possible previously to deposit and wipe away the prescribed cleaning liquid on the nozzle surface, and hence the nozzle surface can be cleaned more efficiently. Furthermore, even if the cleaning liquid is deposited onto the nozzle surface in advance in this way, the excess liquid is swept with the sweeping device before wiping with the wiping device, and therefore it is possible to clean the nozzle surface reliably without the occurrence of wiping residue.

According to the present invention, it is possible reliable to clean the nozzle surface while preventing liquid from being pushed into the nozzles during cleaning of the nozzle surface.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, an inkjet recording apparatus according to an embodiment of the present invention which records an image on a cut sheet of paper.

Composition of Image Recording Unit of Inkjet Recording Apparatus

Figure 1:
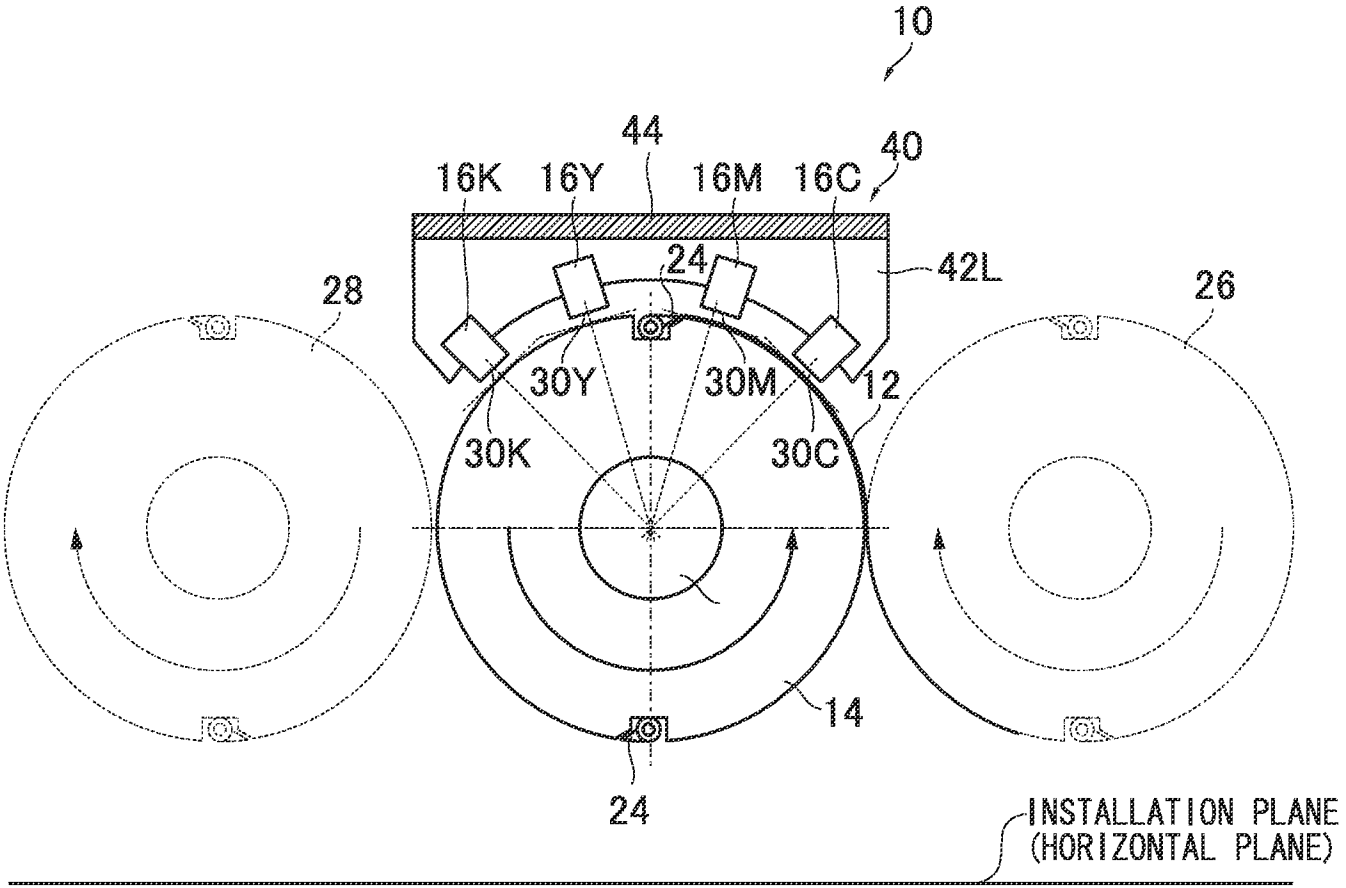
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, the image recording unit 10 of the inkjet recording apparatus according to the present embodiment conveys a medium (cut sheet of paper) 12 by means of an image recording drum 14. Droplets of inks of respective colors of cyan (C), magenta (M), yellow (Y), black (K) are ejected and deposited on a surface of the medium 12 from inkjet heads (droplet ejection heads) 16C, 16M, 16Y and 16K, which are arranged about the periphery of the image recording drum 14, whereby a color image is recorded on the surface of the medium 12.

Figure 2:
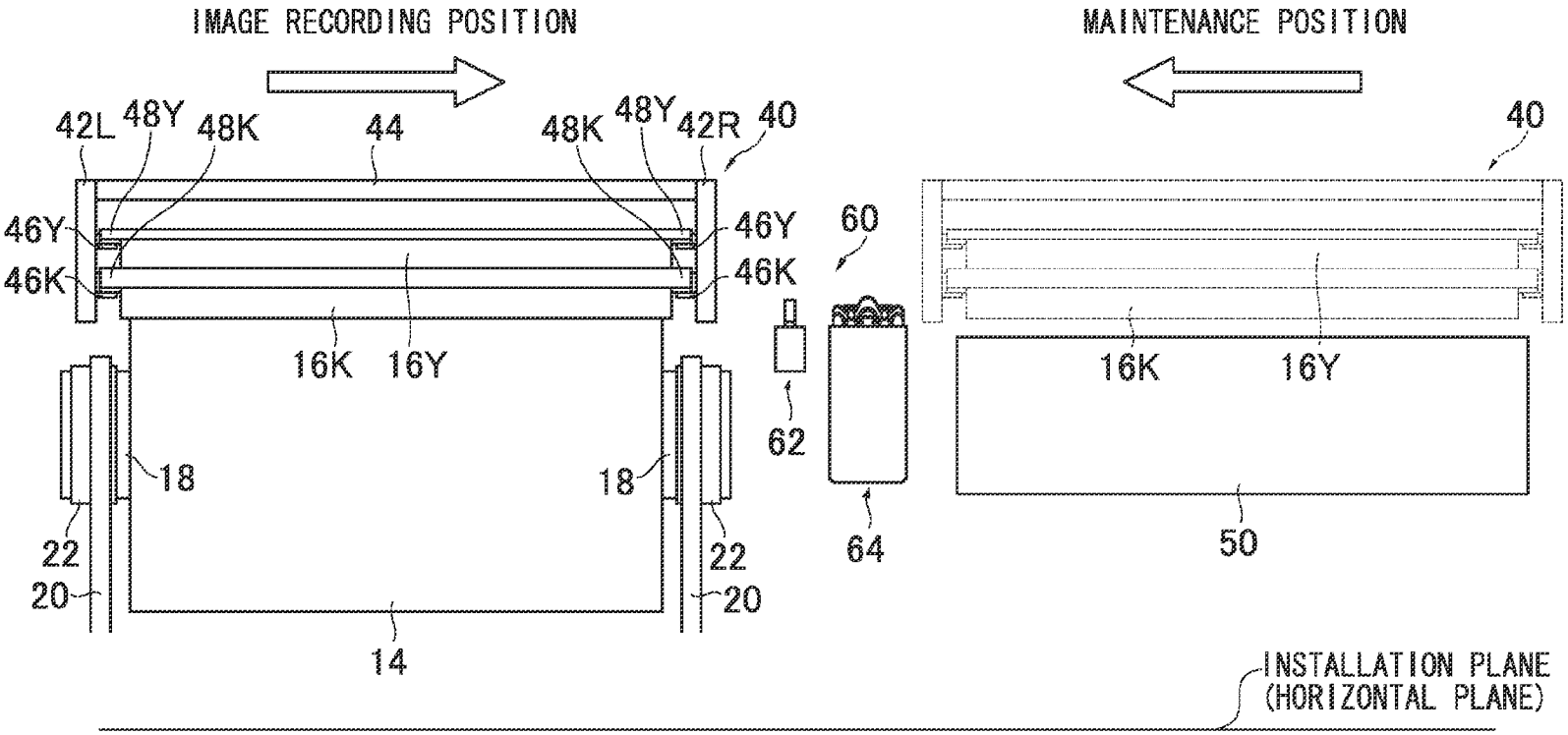
FIG. 2 is a front view diagram of the image recording unit of the inkjet recording apparatus.

The image recording drum 14 is arranged rotatably, and end portions of a rotating shaft 18 of the image recording drum 14 are supported on a pair of bearings 22 (see FIG. 2). The bearings 22 are arranged on a main frame 20 of the inkjet recording apparatus, and due to the end portions of the rotating shaft 18 being supported on this pair of bearings 22, the image recording drum 14 is installed horizontally (the rotating shaft 18 is installed in parallel with the horizontal installation surface).

A motor is coupled to the rotating shaft 18 of the image recording drum 14 through a rotation transmission mechanism (not illustrated). The image recording drum 14 is driven by the motor to rotate.

The image recording drum 14 is provided with grippers 24 arranged on the circumferential surface thereof (in the present embodiment, at two locations on the outer circumferential surface thereof) so as to grip a leading end portion of the medium 12. The leading end portion of the medium 12 is gripped by the grippers 24 and thereby held on the outer circumferential surface of the image recording drum 14.

The image recording drum 14 is further provided with an attraction holding mechanism which is not illustrated (for example, an electrostatic attraction mechanism or a vacuum suction mechanism). The medium 12 which is wrapped about the outer circumferential surface of the image recording drum 14 and the leading end portion of which is gripped by the gripper 24 is held by attraction on the rear surface side thereof by the attraction holding mechanism and thereby held on the outer circumferential surface of the image recording drum 14.

In the inkjet recording apparatus according to the present embodiment, the medium 12 is transferred to the image recording drum 14 through a conveyance drum 26 from a previous step. The conveyance drum 26 is disposed in parallel with the image recording drum 14 and transfers the medium 12 onto the image recording drum 14 in a synchronized fashion.

Furthermore, the medium 12 after the image recording is transferred to a subsequent step through a conveyance drum 28. The conveyance drum 28 is disposed in parallel with the image recording drum 14 and receives the medium 12 from the image recording drum 14 in a synchronized fashion.

The four inkjet heads 16C, 16M, 16Y and 16K are constituted of line heads having widths corresponding to the width of the medium, and are arranged at uniform intervals apart radially on a circle concentric with the rotating shaft 18 of the image recording drum 14.

In the present embodiment, the four inkjet heads 16C, 16M, 16Y and 16K are arranged horizontally symmetrically about the image recording drum 14. In other words, the cyan inkjet head 16C and the black inkjet head 16K are disposed symmetrically with respect to the vertical line that passes through the center of the image recording drum 14, and the magenta inkjet head 16M and the yellow inkjet head 16Y are also disposed horizontally symmetrically with respect to the same vertical line.

Nozzle surfaces 30C, 30M, 30Y and 30K, which are formed at lower ends of the inkjet heads 16C, 16M, 16Y and 16K disposed as described above, are positioned so as to face the outer circumferential surface of the image recording drum 14, and the nozzle surfaces 30C, 30M, 30Y and 30K are disposed at a prescribed height position from the outer circumferential surface of the image recording drum 14 (a uniform gap is formed between the outer circumferential surface of the image recording drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the medium 12.

Ink droplets are ejected perpendicularly toward the outer circumferential surface of the image recording drum 14 from the nozzles which are formed on the nozzle surfaces 30C, 30M, 30Y and 30K of the inkjet heads 16C, 16M, 16Y, 16K disposed as described above.

Figure 3:
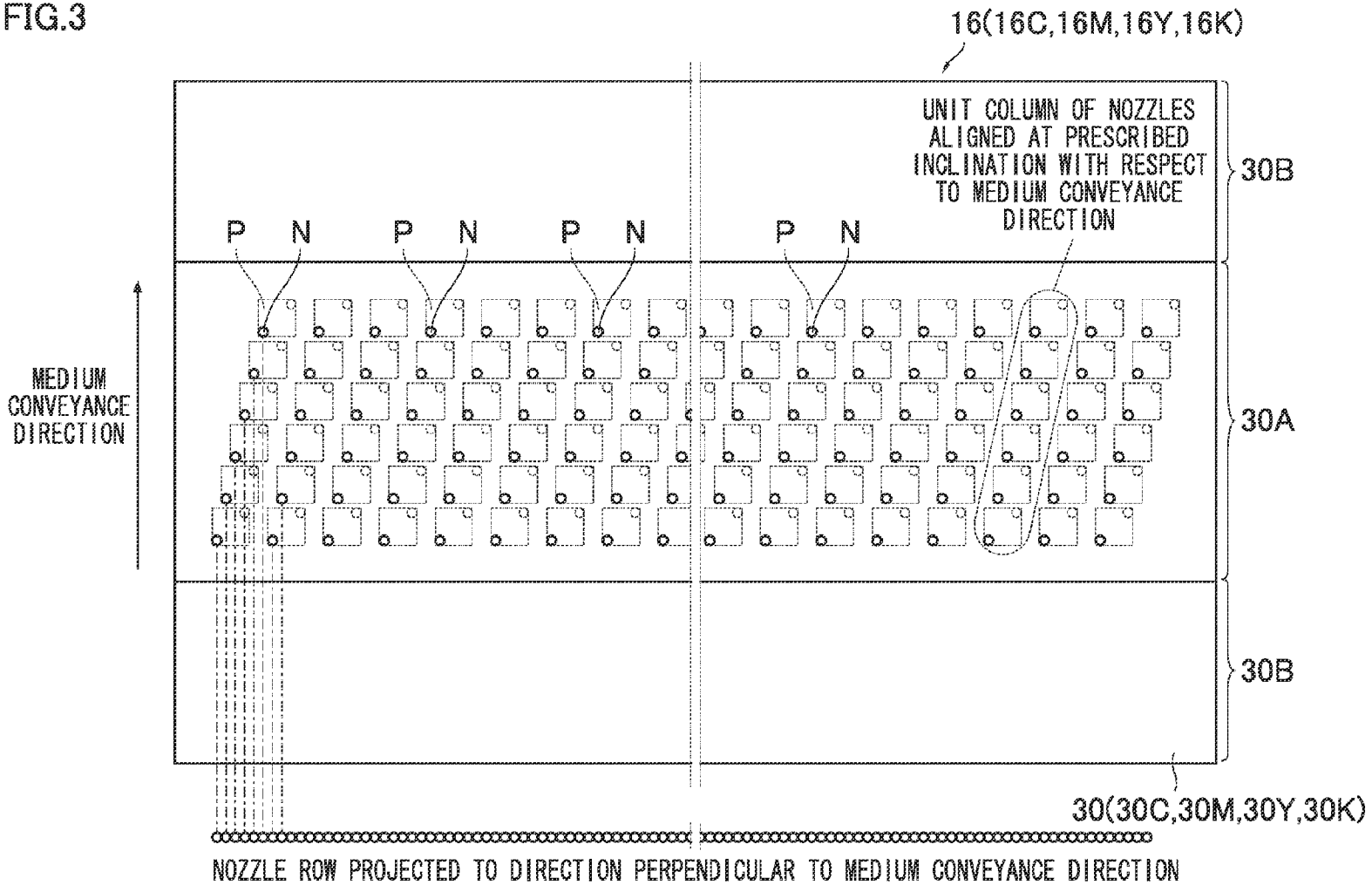
FIG. 3 is a plan view perspective diagram of a nozzle surface of an inkjet head.
Figure 4:
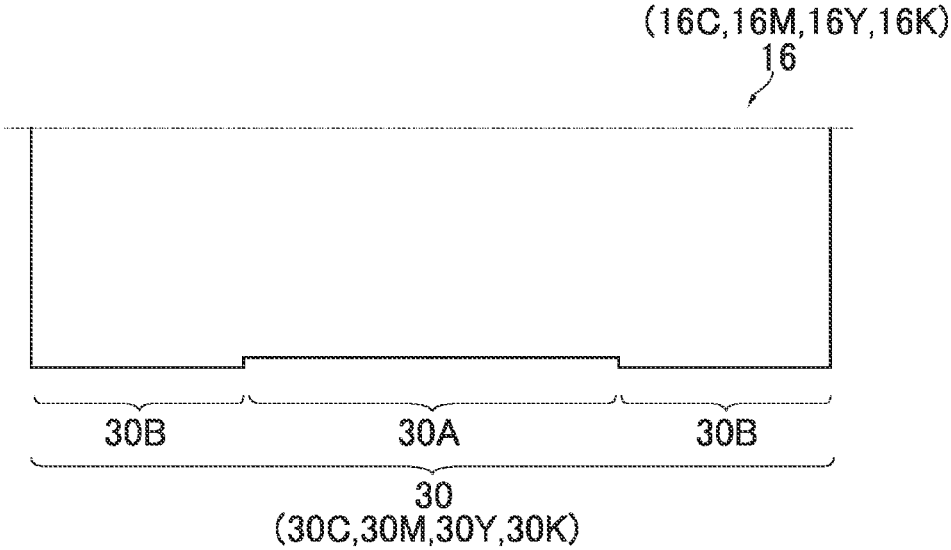
FIG. 4 is a side view diagram showing a cleaning liquid deposition device viewed from the maintenance position side.

FIG. 3 is a plan view perspective diagram of the nozzle surface of the inkjet head, and FIG. 4 is a side view diagram of the lower end region of the inkjet head.

The inkjet heads 16C, 16M, 16Y and 16K each have the same composition, and therefore the composition of one inkjet head 16 and the nozzle surface 30 (30C, 30M, 30Y, 30K) thereof are described here.

As shown in FIG. 3, the nozzle surface 30 is formed in a rectangular shape and is constituted of a nozzle forming region 30A having a fixed width in the central portion of the widthwise direction (media conveyance direction) of the nozzle surface 30 and nozzle protecting regions 30B formed symmetrically on either side of the nozzle forming region 30A.

The nozzle forming region 30A is a region where the nozzles are formed and a prescribed liquid repelling treatment is applied on the surface of this region (a liquid repelling film is applied thereon).

Here, as shown in FIG. 3, the inkjet head 16 in the present embodiment is composed by a so-called matrix head and the nozzles N are arranged in a two-dimensional matrix configuration in the nozzle forming region 30A. More specifically, the nozzle rows are formed by arranging the nozzles N at a uniform pitch in a direction inclined by a prescribed angle with respect to the direction of conveyance of the medium 12, and furthermore a plurality of the nozzle rows are arranged at uniform pitch in the direction (the lengthwise direction of the head) which is perpendicular to the conveyance direction of the medium 12. By adopting this arrangement for the nozzles, it is possible to reduce the effective pitch between the nozzles N as projected to the lengthwise direction of the head (namely, a direction perpendicular to the conveyance direction of the medium 12), and therefore a high-density configuration of the nozzles N can be achieved.

In the matrix head, the effective nozzle row is a row of nozzles projected to the lengthwise direction of the head.

The nozzle protecting regions 30B disposed on either side of the nozzle forming region 30A are regions for protecting the nozzle forming region 30A, and the nozzle forming region 30A is formed in a recessed shape which is withdrawn by a prescribed amount (approximately 0.2 mm) from the nozzle protecting regions 30B.

The inkjet head 16 in the present embodiment has the liquid repelling treatment applied only on the nozzle forming region 30A (i.e., no liquid repelling treatment is applied on the nozzle protecting regions 30B). In this case, when liquid adheres to the nozzle protecting regions 30B, the liquid wets and spreads on the nozzle protecting regions 30B.

The inkjet head 16 in the present embodiment ejects droplets of ink from the nozzles N by a so-called piezoelectric ejection system. The nozzles N formed in the nozzle surface 30 are respectively connected to pressure chambers P, and the volume of the pressure chambers P are compressed and expanded by causing the side walls of the pressure chambers P to vibrate by means of piezoelectric elements, and thereby causing droplets to be ejected from the nozzles N.

The ink ejection method is not limited to this and may also adopt a composition which performs ejection by a thermal method.

The image recording unit 10 has the composition described above. In the image recording unit 10, the medium 12 is received onto the image recording drum 14 from the previous step through the conveyance drum 26, and is conveyed in rotation while being held by attraction on the circumferential surface of the image recording drum 14. The medium 12 passes below the inkjet heads 16C, 16M, 16Y and 16K during this conveyance and ink droplets are ejected and deposited from the inkjet heads 16C, 16M, 16Y and 16K onto the recording surface of the medium 12 as the medium 12 passes, thereby forming a color image on the recording surface of the medium 12. The medium 12 on which the image has been recorded is transferred from the image recording drum 14 to the conveyance drum 28 and is conveyed to the subsequent step.

In the image recording unit 10 having the composition described above, the inkjet heads 16C, 16M, 16Y and 16K are installed on a head supporting frame 40 and are arranged around the image recording drum 14 as shown in FIG. 2.

The head supporting frame 40 is constituted of a pair of side plates 42L and 42R, which are arranged perpendicularly to the rotating shaft 18 of the image recording drum 14, and a linking frame 44, which links the pair of side plate 42L and 42R together at the upper end portions thereof.

Each of the side plates 42L and 42R is formed in a plate shape, and the side plates 42L and 42R are disposed so as to face each other across the image recording drum 14. Installation sections 46C, 46M, 46Y and 46K for installing the respective inkjet heads 16C, 16M, 16Y and 16K are provided on the inner side faces of the pair of side plates 42L and 42R (only the installation sections 46Y and 46K are depicted in FIG. 2).

The installation sections 46C, 46M, 46Y and 46K are disposed at a uniform spacing apart radially on a circle concentric with the rotating shaft 18 of the image formation drum 14. The inkjet heads 16C, 16M, 16Y and 16K are installed on the head supporting frame 40 by fixing attachment sections 48C, 48M, 48Y and 48K, which are formed on the respective ends of the heads (only the attachment sections 48Y and 48K are depicted in FIG. 2) onto the installation sections 46C, 46M, 46Y and 46K. By installing the inkjet heads 16C, 16M, 16Y and 16K on the head supporting frame 40, the inkjet heads 16C, 16M, 16Y and 16K are disposed at uniform intervals apart radially on a circle concentric with the rotating shaft 18 of the image formation drum 14.

The head supporting frame 40 for installing the inkjet heads 16C, 16M, 16Y and 16K is arranged slidably in a direction parallel to the rotating shaft 18 of the image formation drum 14 by being guided by guide rails (not illustrated). The head supporting frame 40 is arranged movably between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16C, 16M, 16Y and 16K are disposed about the periphery of the image recording drum 14 and assume a state capable of image recording.

On the other hand, when the head supporting frame 40 is disposed in the maintenance position, the inkjet heads 16C, 16M, 16Y and 16K are retracted from the image recording drum 14. A moisturizing unit 50 for moisturizing the inkjet heads 16C, 16M, 16Y and 16K is provided in this maintenance position. When the inkjet heads 16C, 16M, 16Y and 16K are not used for a long time, the head supporting frame 40 is placed in the maintenance position and the inkjet heads 16C, 16M, 16Y and 16K are moisturized by the moisturizing unit 50. Thereby, ejection failure due to drying is prevented.

The movement of the head supporting frame 40 is controlled by a controller (not shown). This controller is a control unit which performs overall control of the operation of the whole inkjet recording apparatus, and controls the movement of the head supporting frame 40 by controlling the driving of the linear drive mechanism.

A nozzle surface cleaning apparatus 60 for cleaning the nozzle surfaces 30C, 30M, 30Y and 30K of the inkjet heads 16C, 16M, 16Y and 16K is arranged between the image recording position and the maintenance position. When the inkjet heads 16C, 16M, 16Y and 16K are moved from the image recording position to the maintenance position, cleaning liquid is deposited onto the nozzle surfaces 30C, 30M, 30Y and 30K from the nozzle surface cleaning apparatus 60, and the nozzle surfaces 30C, 30M, 30Y and 30K are wiped with absorbent wiping webs and cleaned.

Below, the composition of the nozzle surface cleaning apparatus 60 is described.

Composition of Nozzle Surface Cleaning Apparatus

As shown in FIG. 2, the nozzle surface cleaning apparatus 60 includes: a cleaning liquid deposition device 62, which deposits the cleaning liquid onto the nozzle surfaces 30C, 30M, 30Y and 30K of the inkjet heads 16C, 16M, 16Y and 16K; and a wiping device 64, which wipes the nozzle surface 30C, 30M, 30Y and 30K of the inkjet heads 16C, 16M, 16Y and 16K on which the cleaning liquid has been deposited.

The cleaning liquid deposition device 62 and the wiping device 64 are arranged on a movement path of the head supporting frame 40, and the cleaning liquid deposition device 62 is arranged to the image recording drum 14 side of the wiping device 64. In other words, the cleaning liquid deposition device 62 is arranged on the upstream side of the wiping device 64 in terms of the direction of movement of the head supporting frame 40 from the image recording position toward the maintenance position.

<Composition of Cleaning Liquid Deposition Device>

Figure 5:
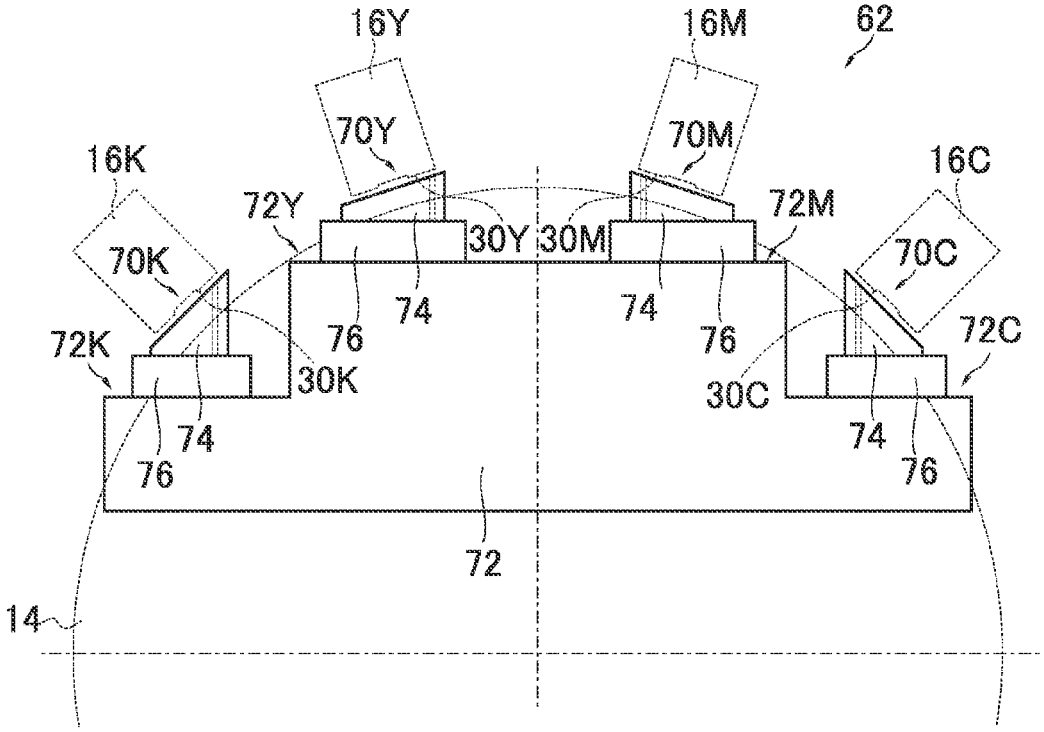
FIG. 5 is a front view diagram of a cleaning liquid deposition unit.

FIG. 5 is a side view diagram showing the cleaning liquid deposition device 62 viewed from the maintenance position side.

The cleaning liquid deposition device 62 is constituted of cleaning liquid deposition units 70C, 70M, 70Y and 70K, which are arranged correspondingly to the inkjet heads 16C, 16M, 16Y and 16K, and a base 72, on which the cleaning liquid deposition unit 70C, 70M, 70Y and 70K are mounted.

<<Composition of Base>>

The base 72 is horizontally arranged so as to be raisable and lowerable by an elevator device (not shown). Cleaning liquid deposition unit attachment sections 72C, 72M, 72Y and 72K are formed in the upper surface portion of the base 72. The cleaning liquid deposition units 70C, 70M, 70Y and 70K are fixed to the cleaning liquid deposition unit attachment sections 72C, 72M, 72Y and 72K formed on the base 72, by bolts, or the like, and are thereby installed in prescribed positions. By installing the cleaning liquid deposition units 70C, 70M, 70Y and 70K on the base 72, the cleaning liquid deposition units 70C, 70M, 70Y and 70K are arranged over the movement path of the corresponding inkjet heads 16C, 16M, 16Y and 16K (namely, over the movement path from the image recording position to the maintenance position).

<<Composition of Cleaning Liquid Deposition Unit>>

Next, the composition of the cleaning liquid deposition units 70C, 70M, 70Y and 70K is described.

The cleaning liquid deposition units 70C, 70M, 70Y and 70K each have the same basic composition and therefore the composition of a cleaning liquid deposition unit 70 is described here.

Figure 6:
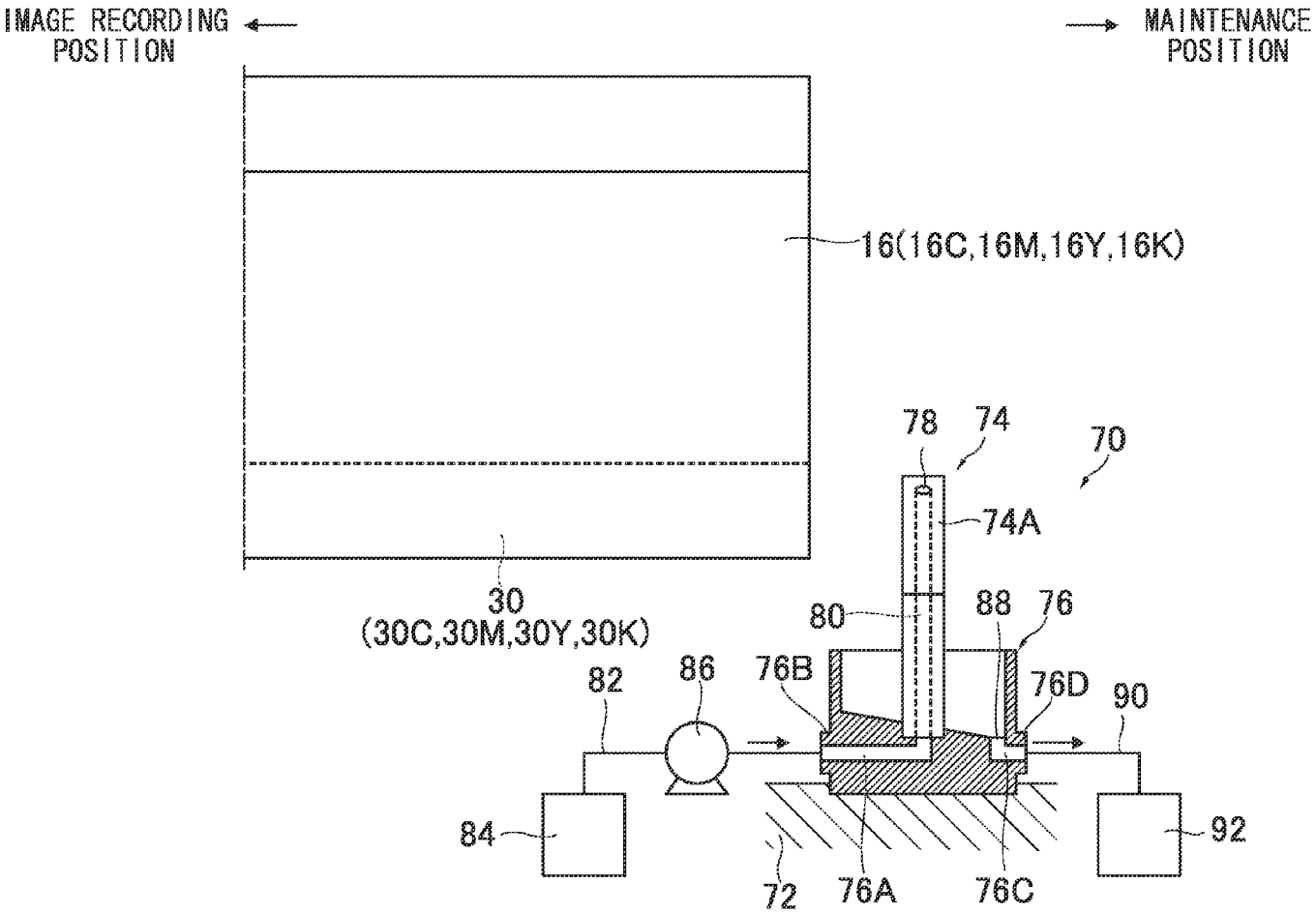
FIG. 6 is a side view diagram showing the cleaning liquid deposition unit viewed from the maintenance position side.
Figure 7:
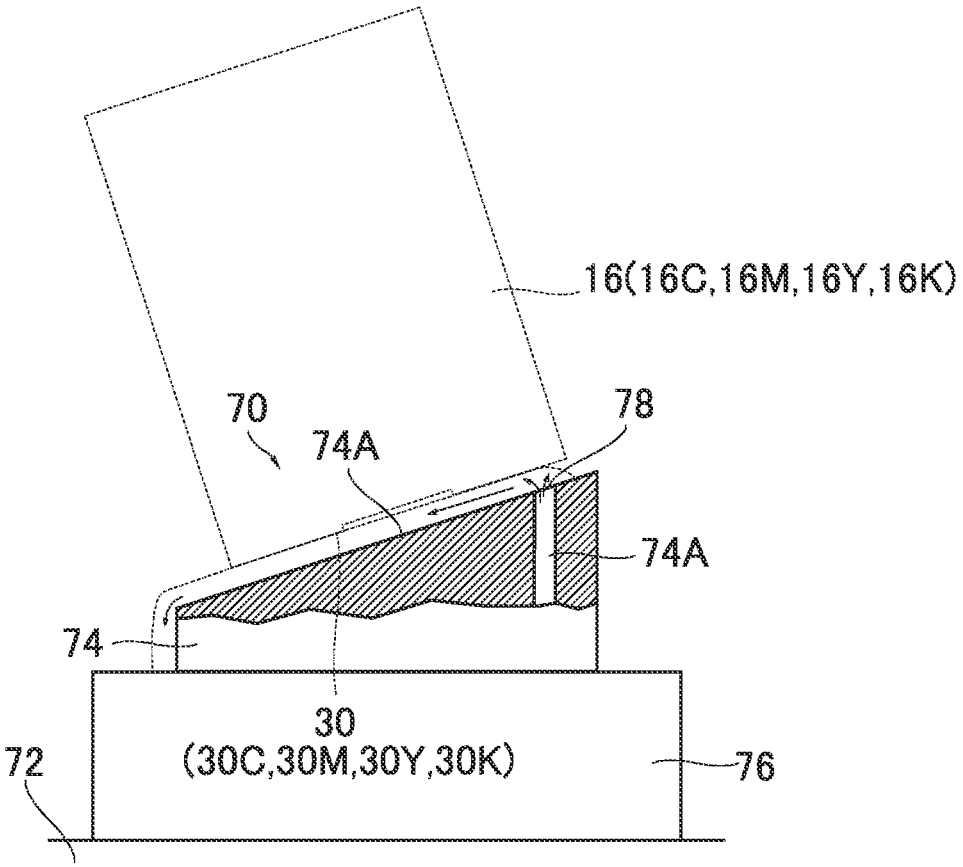
FIG. 7 is a side view diagram showing the cleaning liquid deposition unit viewed from the image recording position side.

FIGS. 6 and 7 are a front view diagram and a side view diagram, respectively, of the cleaning liquid deposition unit 70.

As shown in FIGS. 6 and 7, the cleaning liquid deposition unit 70 includes: a cleaning liquid deposition head 74, which deposits the cleaning liquid onto the nozzle surface 30, and a cleaning liquid recovery tray 76, which recovers the cleaning liquid falling down from the nozzle surface 30.

The cleaning liquid recovery tray 76 is formed in the shape of a rectangular box of which the upper portion is open. The cleaning liquid deposition head 74 is vertically arranged inside the cleaning liquid recovery tray 76.

The cleaning liquid deposition head 74 is formed in a rectangular block shape with an inclined upper surface, and has an inclined cleaning liquid holding surface 74A on the upper portion thereof The cleaning liquid holding surface 74A is formed at the same angle of inclination of the nozzle surface 30 of the head that is to be cleaned, and is formed to a slightly greater width than the width of the nozzle surface 30 (the width in the medium conveyance direction).

A cleaning liquid emission port 78 is formed in the vicinity of the upper part of the cleaning liquid holding surface 74A, and the cleaning liquid flows out from the cleaning liquid emission port 78. The cleaning liquid which has flowed out from the cleaning liquid emission port 78 flows down the inclined cleaning liquid holding surface 74A and is recovered in the cleaning liquid recovery tray 76. By setting the gap between the cleaning liquid holding surface 74A and the nozzle surface 30 to a uniform value, when the nozzle surface 30 passes over the cleaning liquid holding surface 74A, the cleaning liquid which has flowed down over the cleaning liquid holding surface 74A makes contact with the nozzle surface 30 and the cleaning liquid is thereby deposited on the nozzle surface 30.

A cleaning liquid supply flow channel 80 connected to the cleaning liquid emission port 78 is formed inside the cleaning liquid deposition head 74. The cleaning liquid supply flow channel 80 is connected to a connection flow channel 76A formed in the cleaning liquid recovery tray 76. A cleaning liquid supply port 76B connected to the connection flow channel 76A is formed in the cleaning liquid recovery tray 76, and the cleaning liquid flows out from the cleaning liquid emission port 78 due to the cleaning liquid being supplied to the cleaning liquid supply port 76B.

The cleaning liquid supply port 76B is connected to a cleaning liquid supply tank 84 through a cleaning liquid supply channel 82. A cleaning liquid supply pump 86 is arranged at an intermediate position of the cleaning liquid supply channel 82, and by driving the cleaning liquid supply pump 86, the cleaning liquid is supplied from the cleaning liquid supply tank 84 to the cleaning liquid supply port 76B.

The cleaning liquid recovery tray 76 is formed in the shape of the rectangular box, the upper portion of which is open, as described above. The bottom face of the cleaning liquid recovery tray 76 is formed with a cleaning liquid recovery hole 88. A cleaning liquid discharge port 76D connected to the cleaning liquid recovery hole 88 through a cleaning liquid recovery flow channel 76C is formed in the side face portion of the cleaning liquid recovery tray 76.

The cleaning liquid discharge port 76D is connected to a cleaning liquid recovery tank 92 through a cleaning liquid recovery channel 90. The cleaning liquid recovered by the cleaning liquid recovery tray 76 is recovered into the cleaning liquid recovery tank 92.

Each of the cleaning liquid deposition units 70 (70C, 70M, 70Y, 70K) is composed as described above. The cleaning liquid deposition device 62 is composed by installing the cleaning liquid deposition units 70C, 70M, 70Y and 70K on the cleaning liquid deposition unit installation sections 72C, 72M, 72Y and 72K formed in the base 72.

The operation of the cleaning liquid deposition device 62 is controlled by a controller, which is not illustrated. The controller controls the cleaning liquid deposition operation by the cleaning liquid deposition device 62 by controlling the driving of the elevator device, the cleaning liquid supply pump 86, and the like.

Examples of the cleaning liquid include liquid that contains diethylene monobutyl ether as a main component. By applying this type of cleaning liquid onto the nozzle surface 30, a fixed substance deriving from the ink adhered to the nozzle surface 30 can be resolved and removed more easily.

<<Action of Cleaning Liquid Deposition Device>>

Next, a cleaning liquid deposition operation by the cleaning liquid deposition device 62 having the composition described above is explained.

The cleaning liquid deposition device 62 deposits the cleaning liquid onto the nozzle surfaces 30 (30C, 30M, 30Y, 30K) of the inkjet heads 16 (16C, 16M, 16Y, 16K) while the inkjet heads 16 (16C, 16M, 16Y, 16K) move from the image recording position to the maintenance position. More specifically, the cleaning liquid is deposited as follows.

The whole of the cleaning liquid deposition device 62 is arranged raisable and lowerable. When not performing cleaning, the cleaning liquid deposition device 62 is disposed in a prescribed standby position. During cleaning, the cleaning liquid deposition device 62 is raised by a prescribed amount from the standby position to a prescribed operating position.

When the cleaning liquid deposition device 62 is moved to the operating position, the cleaning liquid deposition units 70C, 70M, 70Y and 70K are set in prescribed cleaning liquid deposition positions. Thereby, it is possible to deposit the cleaning liquid onto the nozzle surfaces 30C, 30M, 30Y and 30K of the inkjet heads 16C, 16M, 16Y and 16K, by means of the cleaning liquid deposition heads 74 arranged in the cleaning liquid deposition units 70C, 70M, 70Y and 70K. In other words, when the cleaning liquid deposition units 70C, 70M, 70Y and 70K are set in the cleaning liquid deposition position, they are set in the positions where the cleaning liquid which has flowed over the cleaning liquid holding surfaces 74A of the cleaning liquid deposition heads 74 makes contact with the nozzle surfaces 30C, 30M, 30Y and 30K (i.e., the positions where the gaps between the cleaning liquid holding surfaces 74A and the nozzle surfaces 30C, 30M, 30Y and 30K are in a prescribed range).

When the cleaning liquid deposition units 70C, 70M, 70Y and 70K are set in the prescribed cleaning liquid deposition position, the controller drives the linear drive mechanism and causes the head supporting frame 40 to move at a prescribed speed of movement from the image recording position to the maintenance position.

On the other hand, the controller also drives the cleaning liquid supply pump 86 in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid flows out at a prescribed flow rate from the cleaning liquid emission ports 78 of the cleaning liquid deposition heads 74 in the respective cleaning liquid deposition units 70C, 70M, 70Y and 70K. The cleaning liquid which has flowed out from the cleaning liquid emission ports 78 flows down over the cleaning liquid holding surfaces 74A.

When the inkjet heads 16C, 16M, 16Y and 16K moving toward the maintenance position pass the cleaning liquid deposition heads 74, the cleaning liquid which has flowed over the cleaning liquid holding surfaces 74A of the cleaning liquid deposition heads 74 contacts the nozzle surfaces 30C, 30M, 30Y and 30K, and the cleaning liquid is thereby deposited on the nozzle surfaces 30C, 30M, 30Y and 30K.

<Composition of Wiping Device>

Figure 8:
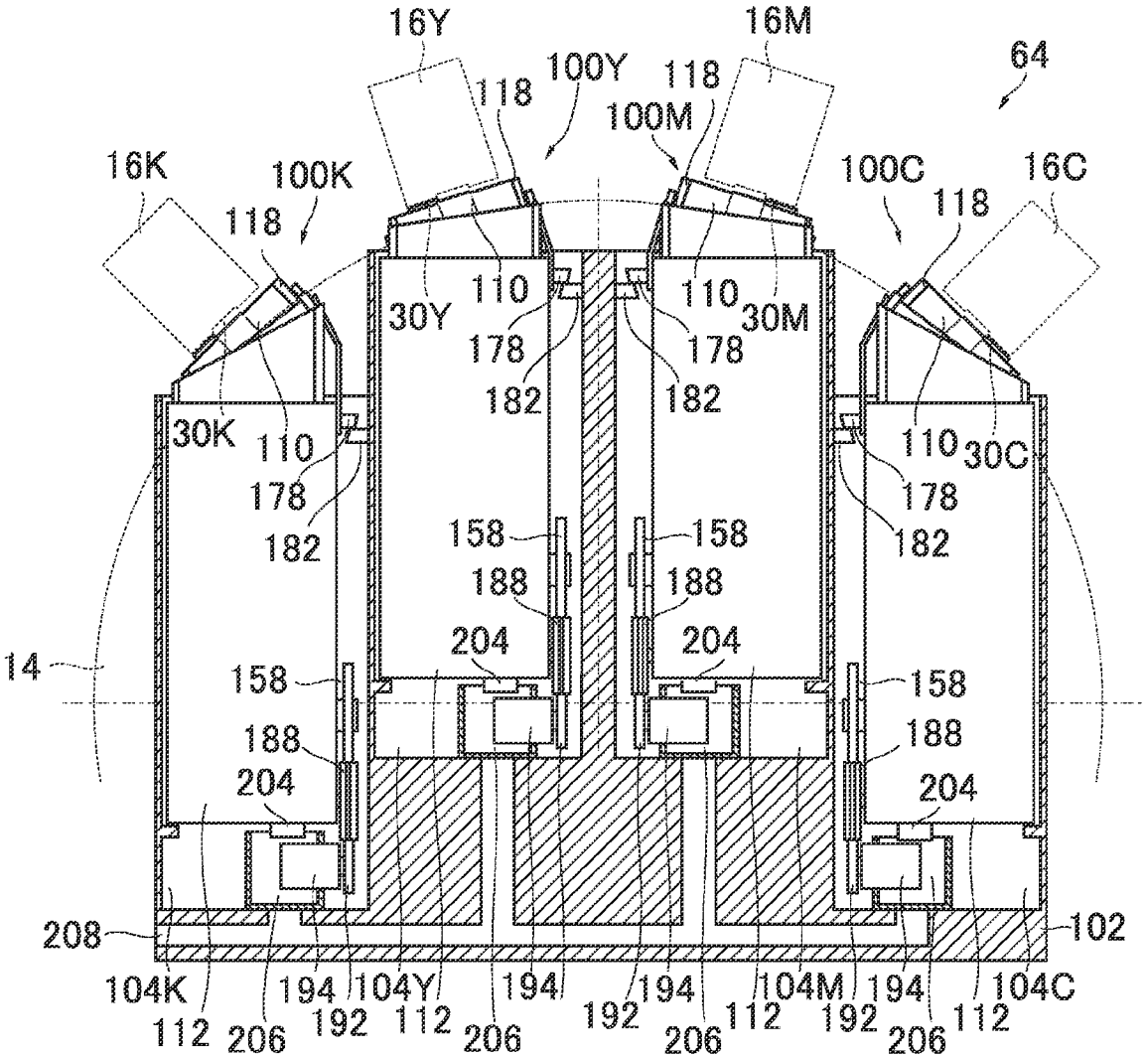
FIG. 8 is a side view diagram showing the composition of a wiping device.

FIG. 8 is a side view diagram showing the wiping device 64 viewed from the maintenance position side.

As shown in FIG. 8, the wiping device 64 includes wiping units 100C, 100M, 100Y and 100K, which are arranged correspondingly to the inkjet heads 16C, 16M, 16Y and 16K, and a rack 102, in which the wiping units 100C, 100M, 100Y and 100K are set.

<<Composition of Rack>>

The rack 102 is horizontally arranged so as to be raisable and lowerable by an elevator device (not shown). The rack 102 is formed in a box shape having an open upper end portion, and installation sections 104C, 104M, 104Y and 104K for installing the wiping units 100C, 100M, 100Y and 100K are arranged inside the rack 102. The wiping units 100C, 100M, 100Y and 100K are set in the respective installation sections 104C, 104M, 104Y and 104K by being inserted vertically downward through the upper end openings of the installation sections 104C, 104M, 104Y and 104K.

<<Composition of Wiping Unit>>

Next, the composition of the wiping units 100C, 100M, 100Y and 100K is described.

The wiping units 100C, 100M, 100Y and 100K all have the same basic composition and therefore the composition is described here with respect to one wiping unit 100.

Figure 9:
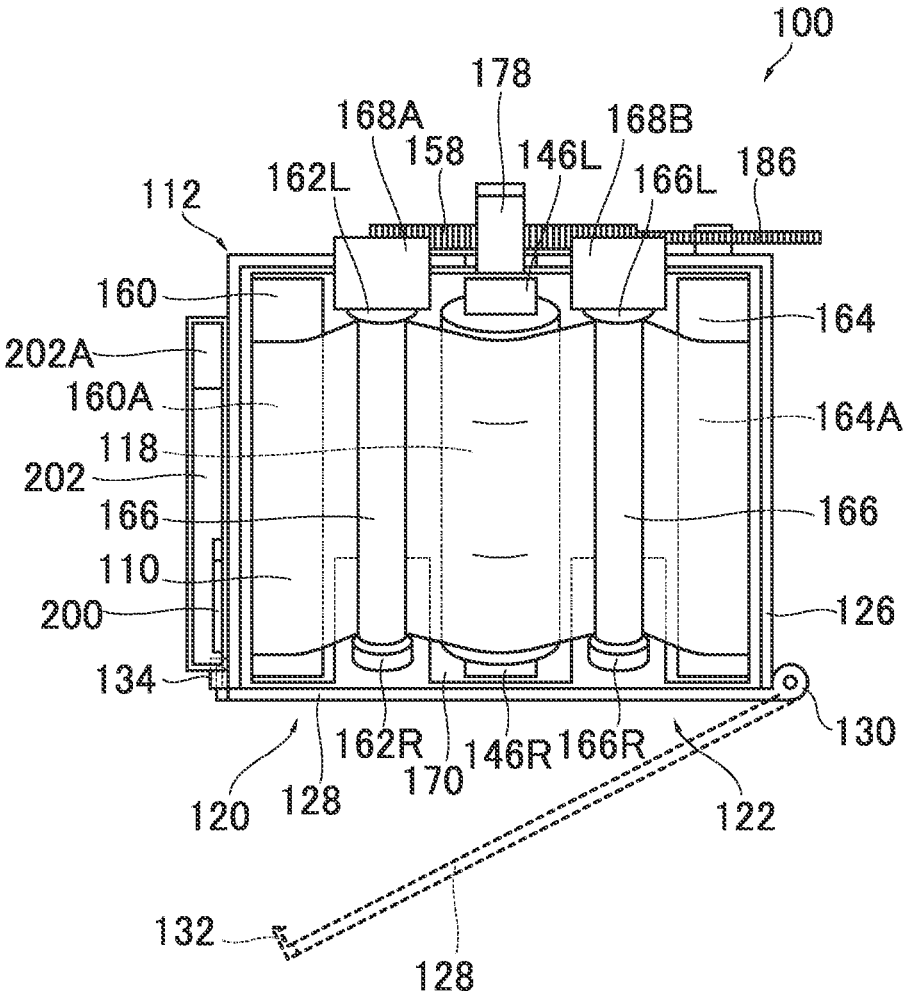
FIG. 9 is a plan diagram of a wiping unit.
Figure 10:
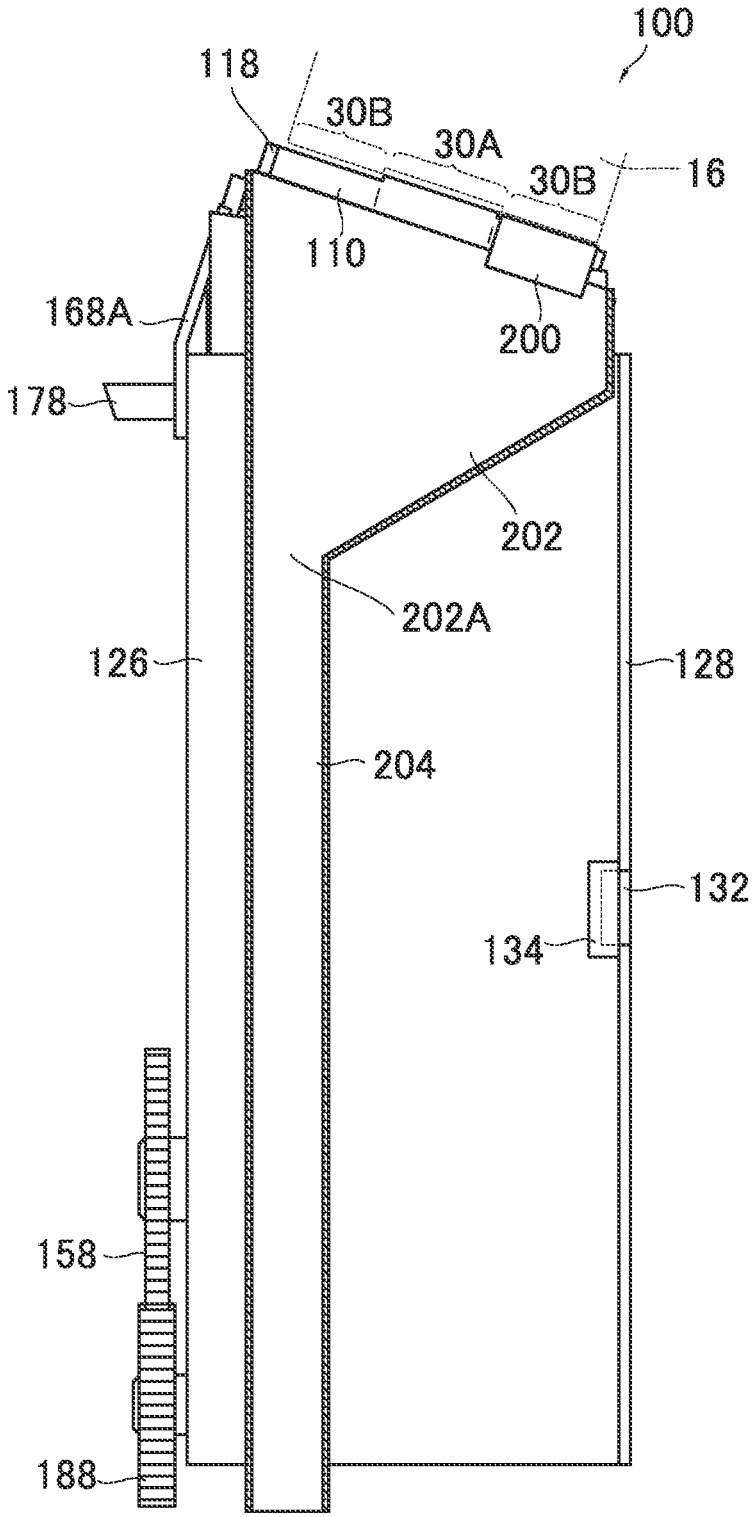
FIG. 10 is a side view diagram showing the wiping unit viewed from the image recording position side.
Figure 11:
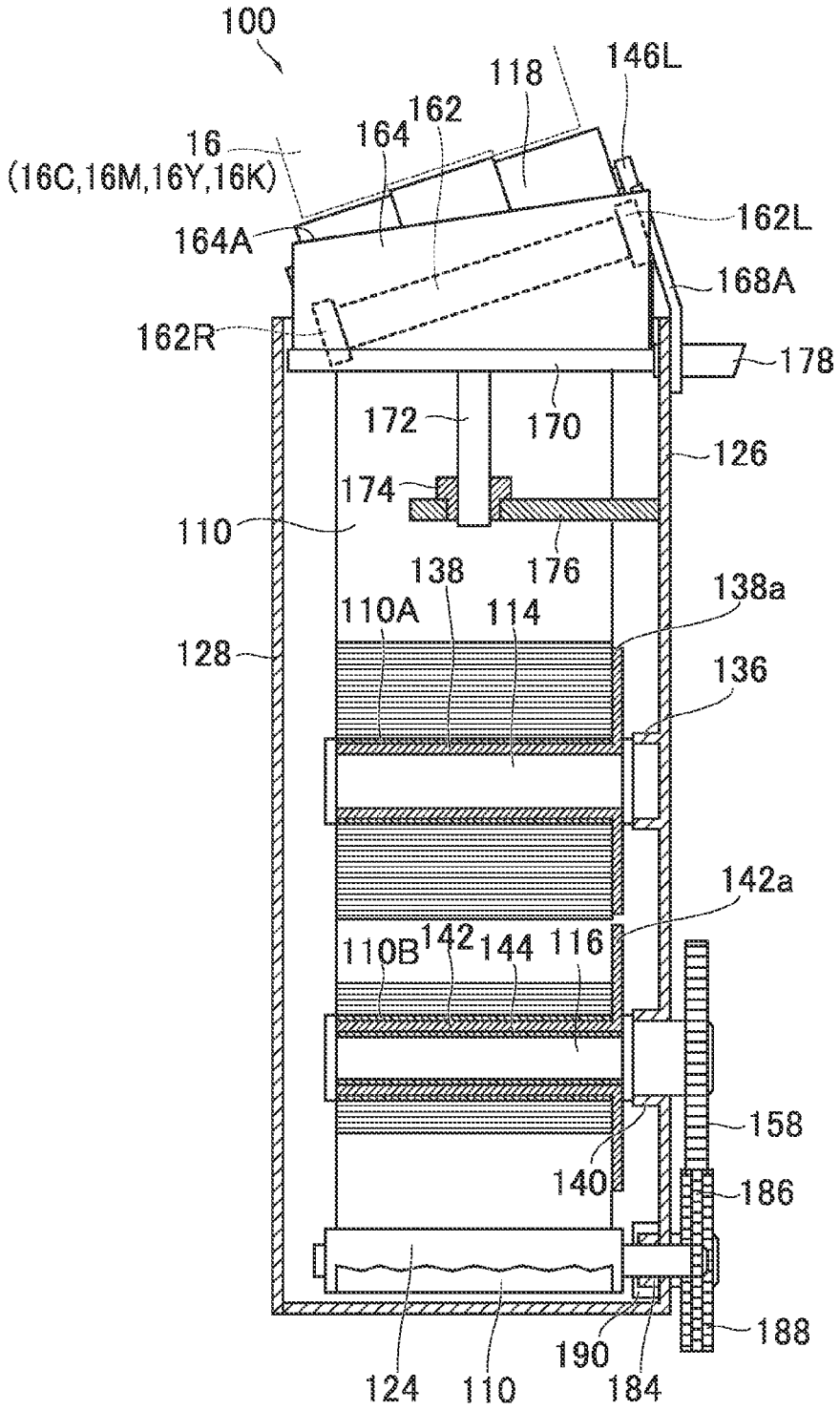
FIG. 11 is a partial cross-sectional side view diagram of the wiping unit.
Figure 12:
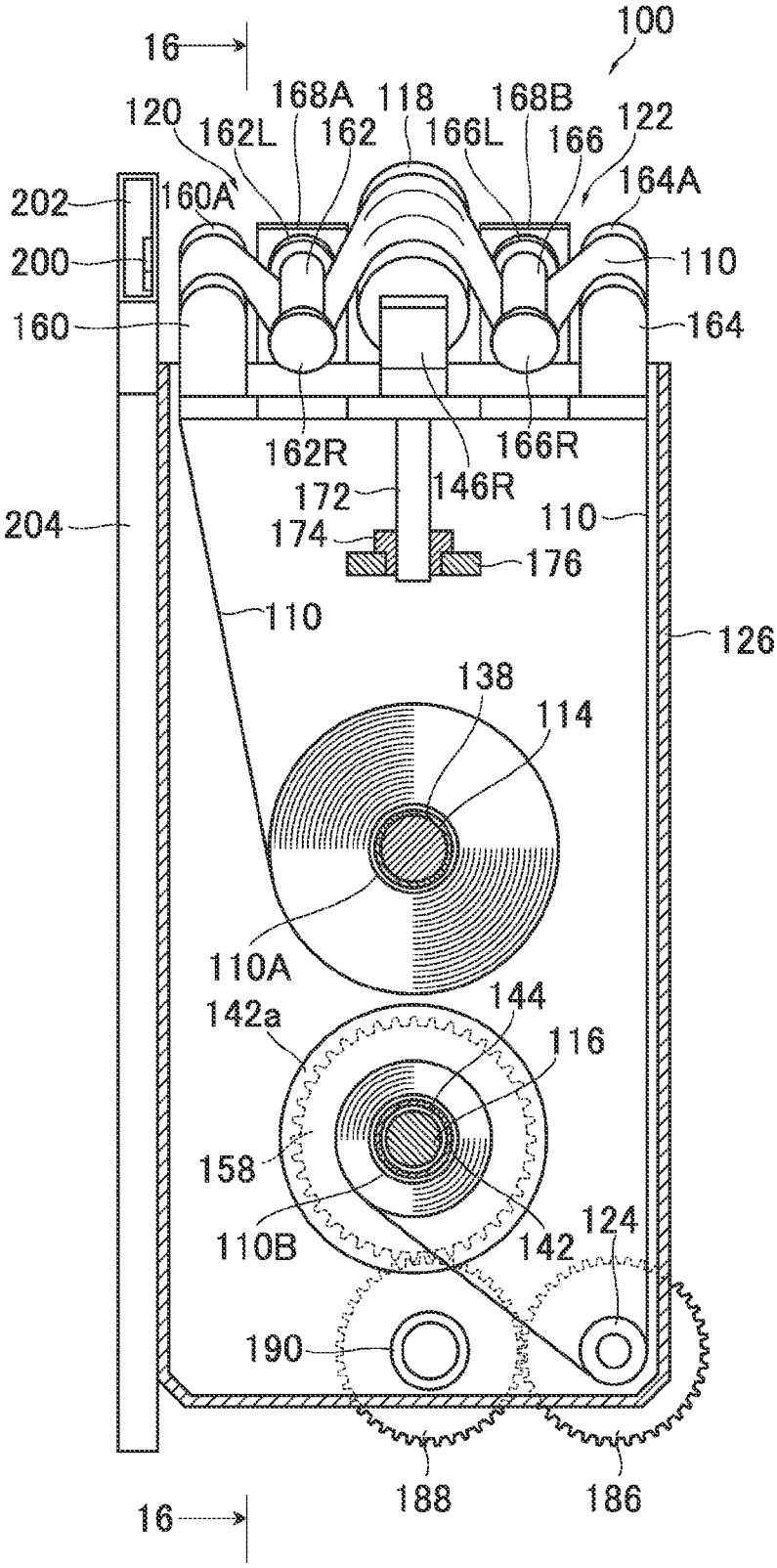
FIG. 12 is a partial cross-sectional front view diagram of the wiping unit.
Figure 13:
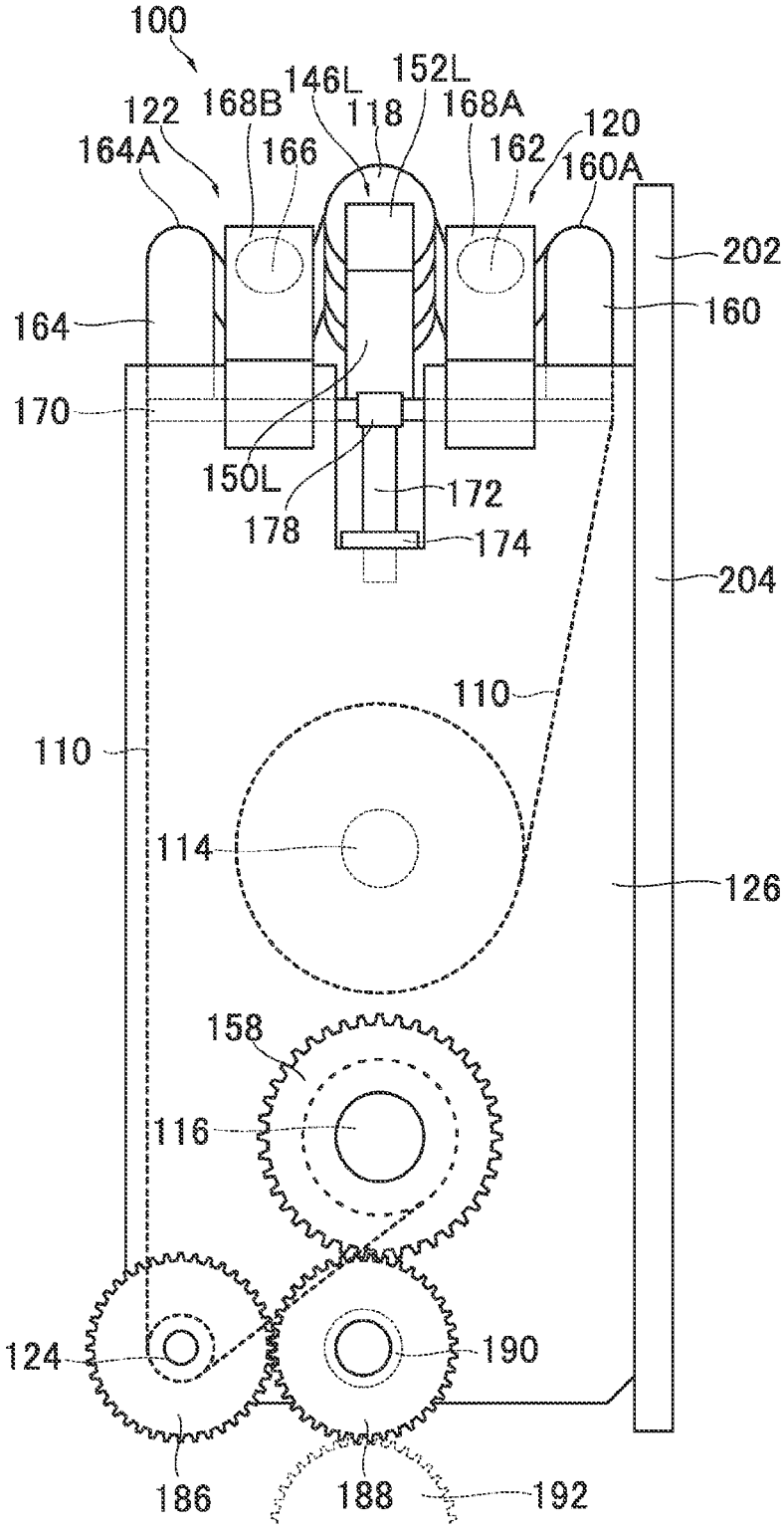
FIG. 13 is a rear view diagram of the wiping unit.

FIG. 9 is a plan diagram of the wiping unit 100, FIG. 10 is a side view diagram of the wiping unit 100 viewed from the image recording position side, FIG. 11 is a partial cross-sectional side view diagram of the wiping unit 100, FIG. 12 is a partial cross-sectional front view diagram of the wiping unit 100, and FIG. 13 is a rear view diagram of the wiping unit 100.

As shown in FIGS. 9 to 13, the wiping unit 100 has a wiping web 110 formed in a band shape, which is wrapped about a pressing roller 118 obliquely disposed, and the wiping unit 100 wipes and cleans the nozzle surface of the inkjet head by pressing the wiping web 110 wrapped about the pressing roller 118, against the nozzle surface of the inkjet head.

The wiping unit 100 includes: a case 112; a supply spindle 114, which supplies the wiping web 110; a take-up spindle 116, which takes up the wiping web 110; a front-stage guide 120, which guides the wiping web 110 supplied from the supply spindle 114 so as to be wrapped about the pressing roller 118; a rear-stage guide 122, which guides the wiping web 110 having been wrapped about the pressing roller 118 so as to be taken up onto the take-up spindle 116; and a drive roller 124, which drives the wiping web 110.

The wiping unit 100 is provided with a blade 200 that sweeps excess liquid (for example, cleaning liquid and ink) from the nozzle surface 30 before wiping the nozzle surface 30 of the inkjet nozzle 16 in use of the wiping web 110.

The case 112 is constituted of a case main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The supply spindle 114 is disposed so that the axis thereof is horizontal, and the base end portion thereof is rotatably supported on a bearing section 136, which is arranged in the case main body 126. A supply reel 138 having a flange 138*a* on the base end portion thereof is installed on the supply spindle 114. The supply reel 138 is fixed onto the supply spindle 114, and rotates in unison with the supply spindle 114.

As described below, the wiping web 110 which is wrapped in the form of a roll about a winding core 110A is installed on the supply spindle 114 by fitting the winding core 110A onto the supply reel 138.

A band-shaped wiping web formed by minute stitching or weaving formed of, for example, PET (polyethylene terephthalate), PE (polyethylene), and NY (nylon) can be used as the wiping web 110.

The take-up spindle 116 is disposed so that the axis thereof is horizontal, at a position below the supply spindle 114. More specifically, the take-up spindle 116 is arranged below and parallel with the supply spindle 114. The vicinity of the base end portion of the take-up spindle 116 is rotatably supported on a bearing section 140, which is arranged in the case main body 126.

A take-up reel 142 having a flange 142*a* on the base end portion thereof is installed on the take-up spindle 116. A sliding member 144 is installed on the inner circumference of the axle portion of the take-up reel 142, and is composed so as to slide with respect to the take-up spindle 116 when a prescribed load or greater is applied in the direction of rotation.

As described below, a winding core 110B which is attached to the leading end of the wiping web 110 is installed on the take-up spindle 116 by fitting onto the take-up reel 142.

Furthermore, the take-up spindle 116 is arranged in such a manner that the base end portion thereof projects to the outer side of the case main body 126, and a take-up gear 158 is fixed to this projecting base end portion of the take-up spindle 116.

The take-up spindle 116 is rotated by driving and rotating the take-up gear 158. The related drive system is described hereinafter.

The pressing roller 118 is disposed above the supply spindle 114 (in the present embodiment, the pressing roller 118, the supply spindle 114 and the take-up spindle 116 are disposed on the same straight line), and is arranged at a prescribed inclination with respect to the horizontal plane. In other words, the pressing roller 118 is disposed in accordance with the inclination of the nozzle surface of the inkjet head that is to be cleaned (i.e., the axis of the pressing roller 118 is parallel with the nozzle surface) in order to press the wiping web 110 against the nozzle surface of the inkjet head.

Figure 14:
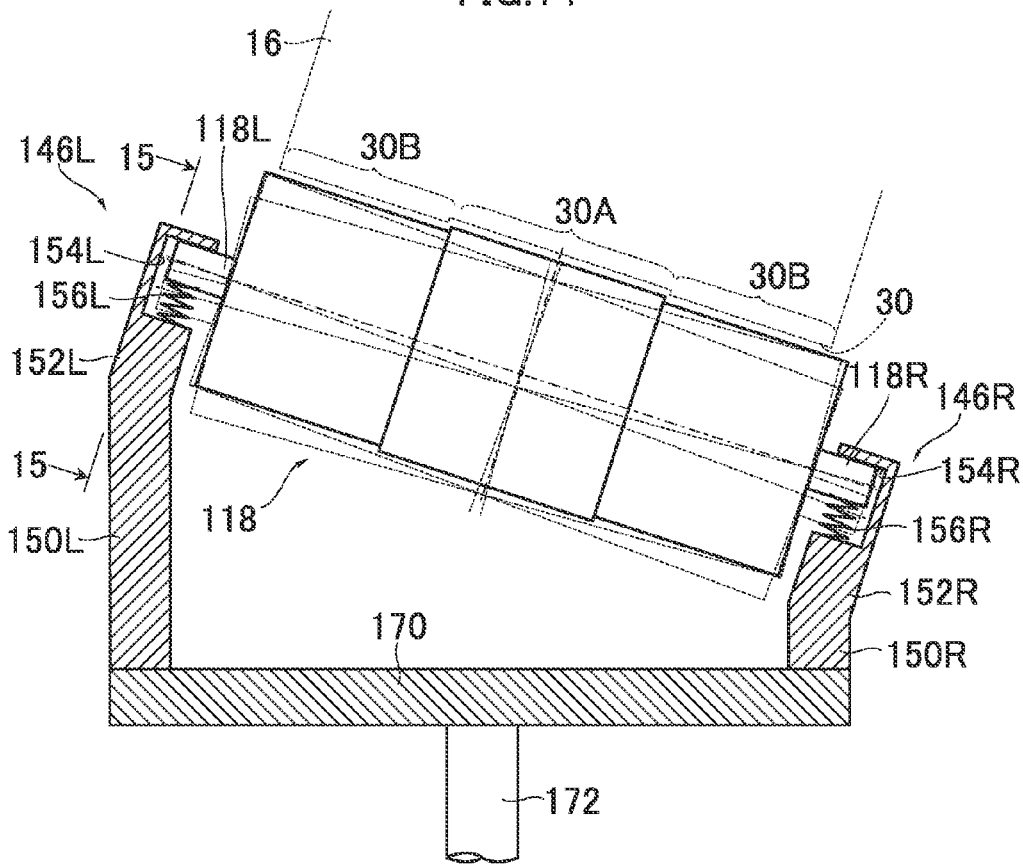
FIG. 14 is a partial cross-sectional front view showing the composition of a bearing section which supports a shaft of a pressing roller.

The pressing roller 118 is formed in such a manner that the central portion thereof has an enlarged diameter in accordance with the cross-sectional shape of the nozzle surface 30 of the inkjet head 16 which is the object of cleaning (see FIG. 14). In the inkjet head 16 in the present embodiment, the central portion of the nozzle surface 30 (i.e., the nozzle forming region 30A) is formed so as to be withdrawn in the recessed shape, and therefore the central portion of the pressing roller 118 is formed so as to project (having a larger diameter than other portions) in accordance with the nozzle surface 30 which is formed in the recessed shape. More specifically, the region (the region which abuts during a wiping operation) corresponding to the nozzle forming region 30A which is withdrawn in the recessed shape is formed so as to project (expand) in accordance with the amount of withdrawal. By this means, it is possible to press the wiping web 110 appropriately against the nozzle forming region 30A which is formed in the withdrawn recessed shape.

The pressing roller 118 is provided with axle portions 118L and 118R, which project on either end portion thereof, and the axle portions 118L and 118R are supported by a pair of axle supporting sections 146L and 146R in a rotatable and swingable fashion.

Figure 15:
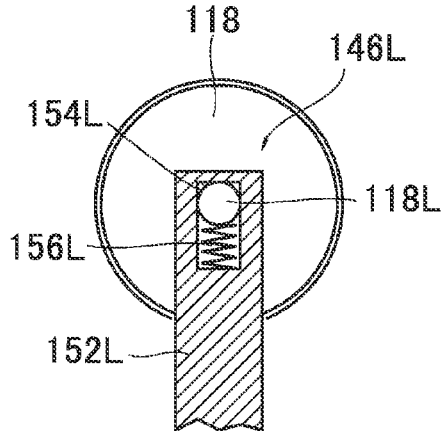
FIG. 15 is a cross-sectional view along line 15-15 in FIG. 14.

FIG. 14 is a partial cross-sectional front view diagram showing the composition of the axle supporting sections which support the axle sections 118L and 118R of the pressing roller 118, and FIG. 15 is a cross-sectional diagram along 15-15 in FIG. 14.

As shown in FIG. 14, the axle supporting sections 146L and the 146R are arranged on an elevator stage 170, which is horizontally disposed. The axle supporting sections 146L and 146R are constituted of pillar sections 150L and 150R, which are vertically erected on the elevator stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to (slightly larger than) the diameter of each of the axle sections 118L and 118R of the pressing roller 118, and the lengthwise direction thereof is perpendicular to the nozzle surface of the inkjet head that is to be cleaned (see FIG. 15). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the inkjet head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upward by the springs 156L and 156R. By this means, it is possible to cause the circumferential surface of the pressing roller 118 to make close contact with the nozzle surface, by following the nozzle surface of the line head that is to be cleaned.

The front-stage guide 120 is constituted of a first front-stage guide 160 and a second front-stage guide 162, and the wiping web 110 supplied from the supply spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been supplied from the supply spindle 114 is changed to a direction substantially perpendicular to the axis of the pressing roller 118 from the direction perpendicular to the axis of the supply spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 16:
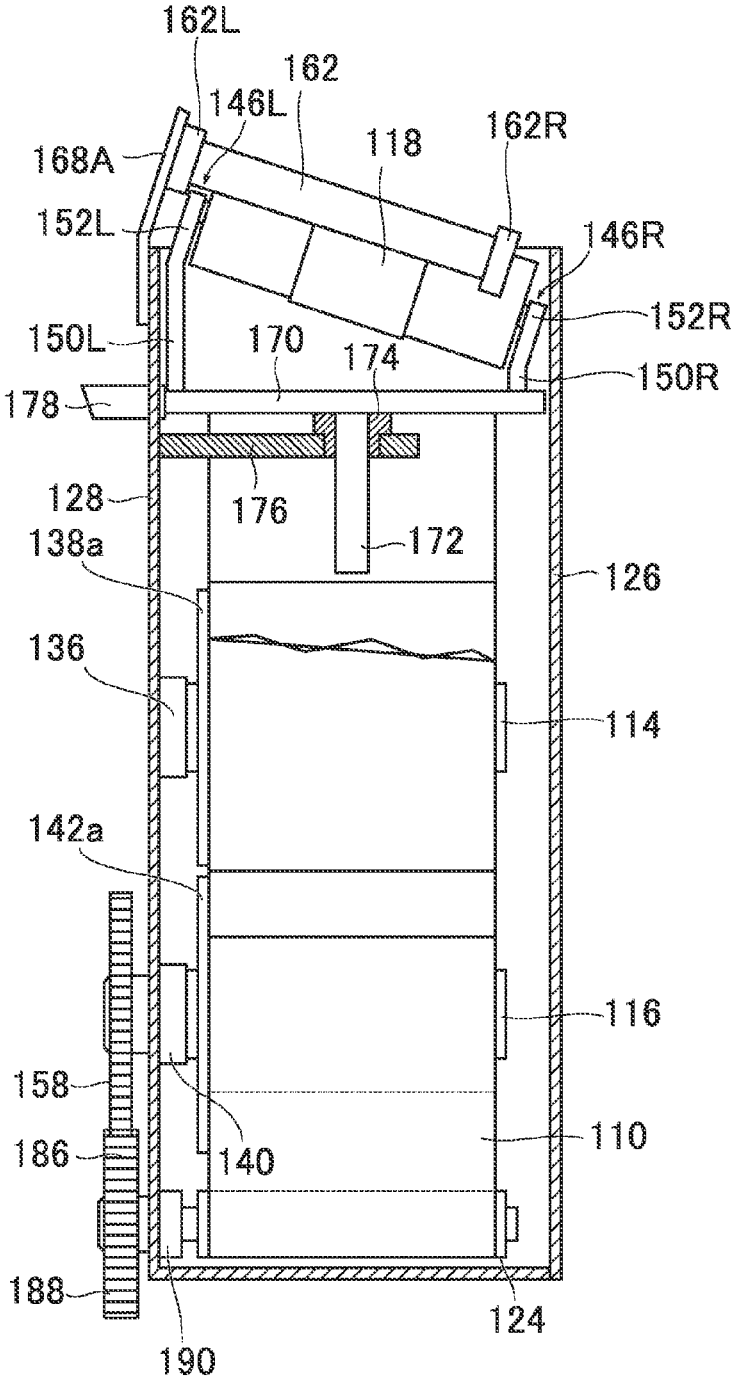
FIG. 16 is a cross-sectional view along line 16-16 in FIG. 12.

The second front-stage guide 162 is supported at only one end thereof on a bracket 168A, and the second front-stage guide 162 is disposed at a prescribed angular inclination. As shown in FIGS. 13 and 16, the bracket 168A is formed in a plate shape with a bent top end, and the base end portion of the bracket 168A is fixed to the upper end portion of the rear face of the case main body 126. The bracket 168A is arranged so as to project perpendicularly upward from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

As described above, the first front-stage guide 160, the pressing roller 118 and the first rear-stage guide 164 (the first structural body constituted of the first front-stage guide 160, the pressing roller 118 and the first rear-stage guide 164) are arranged on the elevator stage 170. The elevator stage 170 can be raised and lowered in the direction vertical to the horizontal plane.

As shown in FIG. 11, a guide shaft 172 is connected integrally with the elevator stage 170. The guide shaft 172 vertically extends downward from the lower face of the elevator stage 170 and is fitted into a guide bush 174 disposed inside the case main body 126. The guide bush 174 is fixed to the inner wall face of the case main body 126 through a supporting member 176, and guides the guide shaft 172 vertically.

Figure 17A:
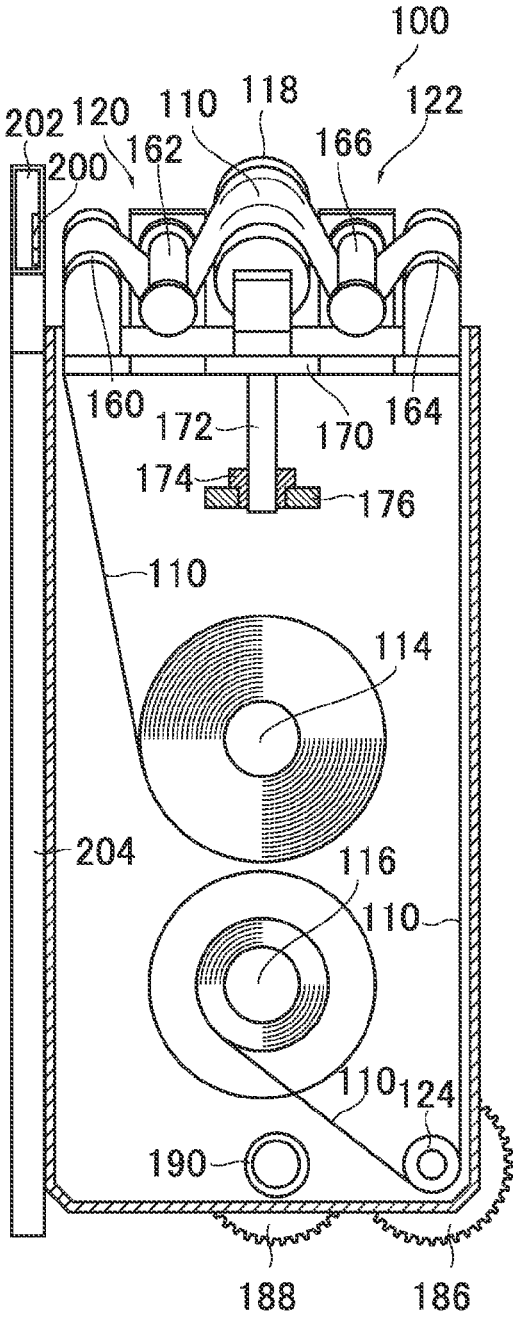
FIG. 17A is an illustrative diagram showing a state of a wiping web in the wiping unit during use.
Figure 17B:
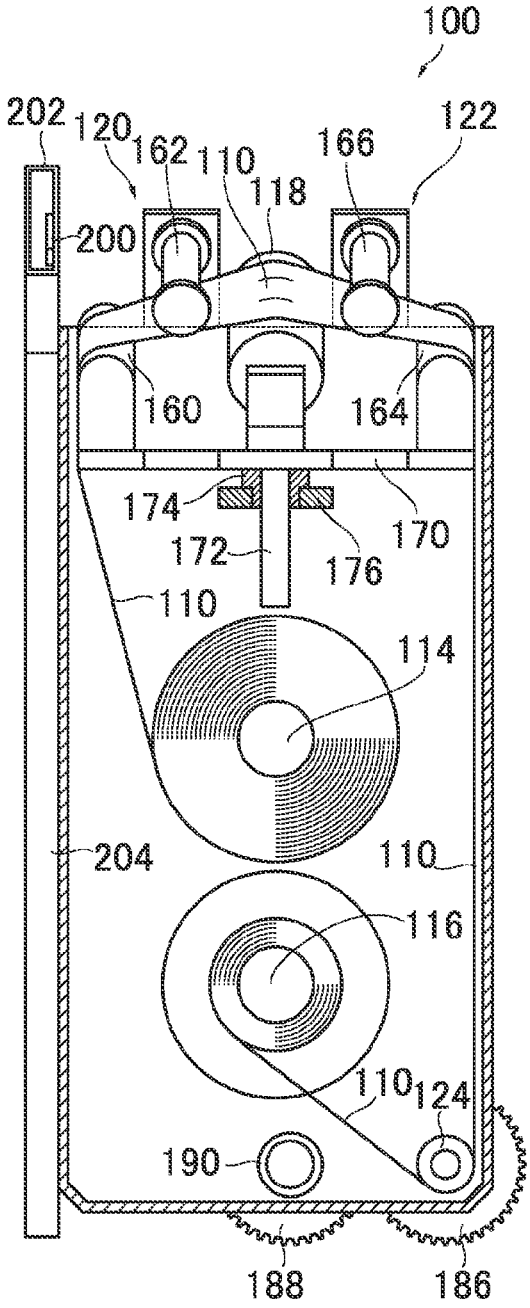
FIG. 17B is an illustrative diagram showing a state of the wiping web during replacement.

In this way, the elevator stage 170 on which the first front-stage guide 160, the pressing roller 118 and the first rear-stage guide 164 are disposed is arranged raisable and lower ably in the direction vertical to the horizontal plane. Therefore, as shown in FIGS. 17A and 17B, by raising and lowering the elevator stage 170, it is possible to cause the first front-stage guide 160, the pressing roller 118 and the first rear-stage guide 164 to advance and retreat with respect to the second front-stage guide 162 and the second rear-stage guide 166 (the second structural body constituted of the second front-stage guide 162 and the second rear-stage guide 166), which are fixedly arranged. By this means, it is possible to simply replace the wiping web 110.

More specifically, by lowering the elevator stage 170, as shown in FIG. 17B, the first front-side guide 160, the pressing roller 118 and the first rear-stage guide 164 can be retracted downward with respect to the second front-stage guide 162 and the second rear-stage guide 166, and therefore a large space between same can be ensured. Thereby, it is possible to simply carry out the task of wrapping the wiping web 110 about the respective sections. Furthermore, the wiping web 110 can be simply wrapped about the respective sections by wrapping the wiping web 110 about the first front-stage guide 160, the pressing roller 118 and the first rear-stage guide 164, with the first front-stage guide 160, the pressing roller 118 and the first rear-stage guide 164 in the downwardly retracted state, and then raising the elevator stage 170. In other words, if the wiping web 110 is wrapped about the first front-stage guide 160, the pressing roller 118 and the first rear-stage guide 164, whereupon the elevator stage 170 is raised, as shown in FIG. 17A, then the wiping web 110 is automatically wrapped about the second front-stage guide 162 and the second rear-stage guide 166.

In this way, by making the first front-stage guide 160, the pressing roller 118 and the first rear-stage guide 164 capable of advancing and retracting with respect to the second front-stage guide 162 and the second rear-stage guide 166, it is possible to simply carry out the task of replacing the wiping web 110.

The first front-stage guide 160, the pressing roller 118 and the first rear-stage guide 164 need to be positioned in the prescribed use position (the position in FIG. 17A) when being used, and the first front-stage guide 160, the pressing roller 118 and the first rear-stage guide 164 are moved to the use position in coordination with the installation of the wiping unit 100 on the rack 102.

This coordinated mechanism will now be described. As shown in FIGS. 11 and 13, an elevator lever (engagement section) 178 is arranged on the elevator stage 170, on which the first front-stage guide 160, the pressing roller 118 and the first rear-stage guide 164 are arranged. The elevator lever 178 is arranged so as to project from the rear face of the case main body 126 through a cutaway portion 180 formed on the rear face of the case main body 126. The elevator stage 170 is raised and lowered by sliding the elevator lever 178.

Figure 18A:
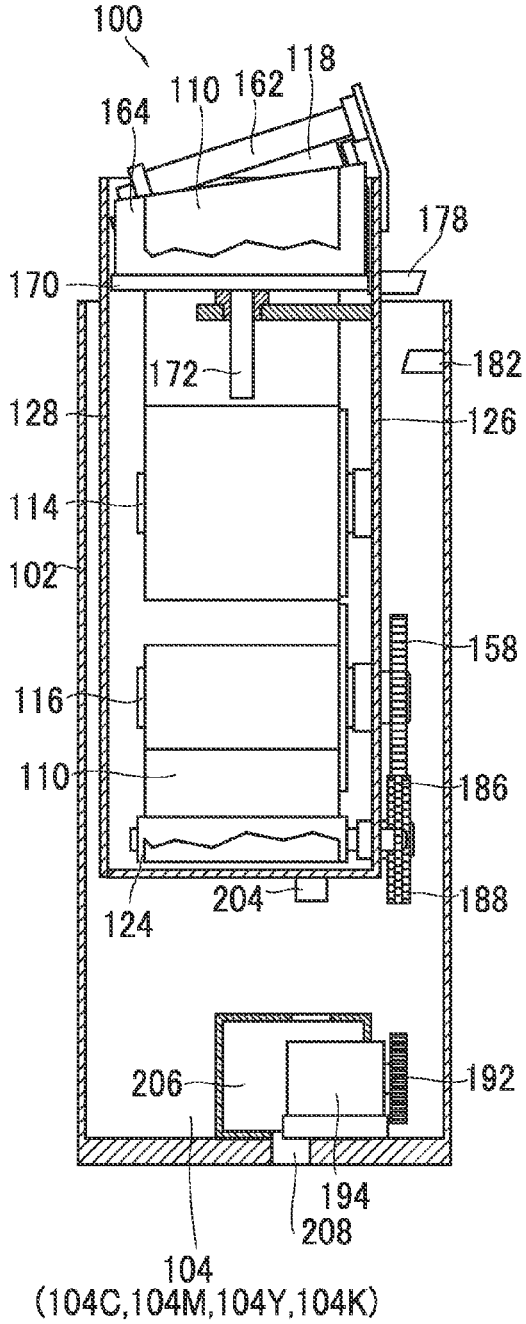
FIGS. 18A and 18B are illustrative diagrams of a coordination mechanism for raising and lowering an elevator table.
Figure 18B:
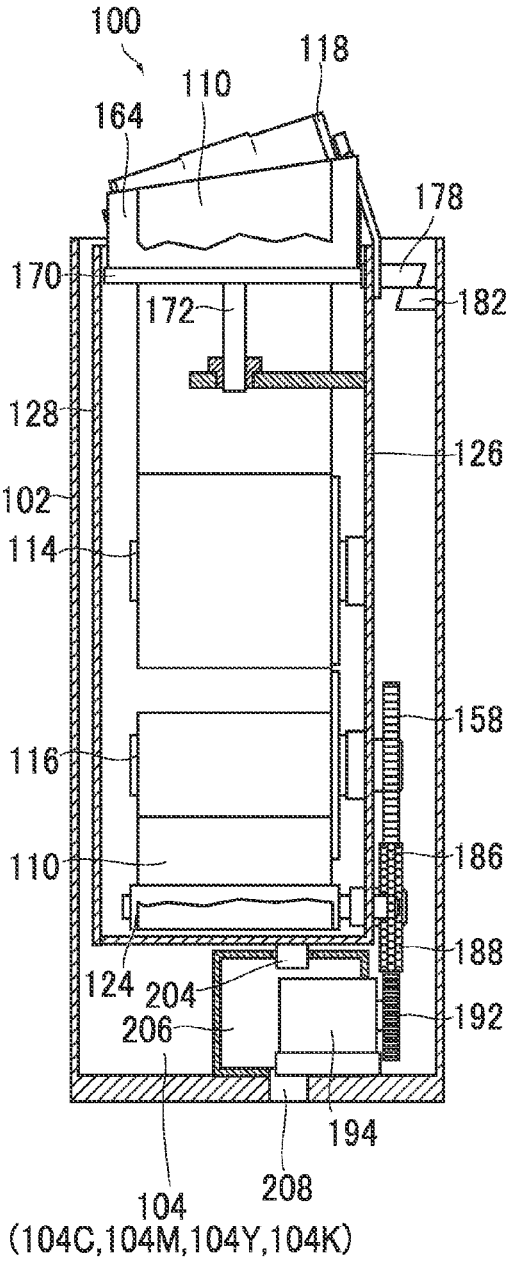

On the other hand, as shown in FIGS. 18A and 18B, a pin (engaged section) 182 is projectingly arranged on the inner side of the installation section 104 (104C, 104M, 104Y and 104K) of the rack 102 in which the wiping unit 100 is set. The pin 182 is arranged so as to engage with the elevator lever 178 arranged on the wiping unit 100 when the wiping unit 100 is installed on the installation section 104.

According to the composition described above, as shown in FIGS. 18A and 18B, when the wiping unit 100 is inserted into the installation section 104 of the rack 102, the elevator lever 178 engages with the pin 182 and is forcibly raised up to a prescribed position. Thereby, the first front-stage guide 160, the pressing roller 118 and the first rear-stage guide 164 are registered in the prescribed use position.

In this way, the first front-stage guide 160, the pressing roller 118 and the first rear-stage guide 164 are moved to the use position in coordination with the installation of the wiping unit 100 on the rack 102.

The drive roller 124 is disposed in the vicinity of the base face of the case main body 126, in a position below the first rear-stage guide 164. The drive roller 124 drives and guides the wiping web 110 of which the travel direction has been changed to the direction perpendicular to the take-up spindle 116 by the first rear-stage guide 164, so that the wiping web 110 is taken up onto the take-up spindle 116.

The drive roller 124 is arranged in parallel with the take-up spindle 116 (namely in parallel with the horizontal plane), and the vicinity of the base end portion thereof is rotatably supported on a bearing section 184, which is arranged on the case main body 126.

Furthermore, the drive roller 124 is arranged in such a manner that the base end portion of the rotating shaft thereof projects to the outer side of the case main body 126, and a roller drive gear 186 is fixed to this projecting base end portion of the rotating shaft. The drive roller 124 is rotated by driving the roller drive gear 186 to rotate.

Here, the drive system of the wiping unit 100 including the drive roller 124 is described.

In the wiping unit 100 according to the present embodiment, by driving the take-up spindle 116 to rotate while also driving the drive roller 124 to rotate, the wiping web 110 is caused to travel from the supply spindle 114 toward the take-up spindle 116. As described above, the take-up gear 158 is fixed to the base end portion of the take-up spindle 116, and the roller drive gear 186 is fixed to the base end portion of the rotating shaft of the drive roller 124. As shown in FIG. 13, the take-up gear 158 and the roller drive hear 186 mesh with an idle gear 188.

The rotating shaft of the idle gear 188 is horizontally arranged and is rotatably supported on a bearing section 190 arranged on the case main body 126. The take-up gear 158 and the roller drive gear 186 are both caused to rotate in the same direction by driving the idle gear 188. The idle gear 188 meshes with a drive gear 192 arranged inside the installation section 104 when the wiping unit 100 is installed in the installation section 104 of the rack 102. More specifically, as shown in FIGS. 18A and 18B, a motor 194 forming a source of drive power is arranged in the base portion of the installation section 104, and the idle gear 188 meshes with the drive gear 192, which is fixed to the output shaft of the motor 194, when the wiping unit 100 is installed in the installation section 104 of the rack 102.

In this way, the idle gear 188 meshes with the drive gear 192 arranged inside the installation section 104 when the wiping unit 100 is installed in the installation section 104 of the rack 102. When the drive gear 192 is caused to rotate by the motor 194, the idle gear 188 rotates and this rotation of the idle gear 188 is transmitted to the roller drive gear 186 of the take-up gear 158, thereby rotating the take-up spindle 116 and the drive roller 124. Due to the rotation of the take-up spindle 116 and the driver roller 124, the wiping web 110 is supplied from the supply spindle 114, and taken up onto the take-up spindle 116 after passing along a prescribed path of travel.

As described above, the sliding member 144 is installed on the inner circumference of the axle portion of the take-up reel 142, which is installed on the take-up spindle 116, and the take-up reel 142 is composed so as to slide with respect to the take-up spindle 116 when the prescribed load or greater is applied in the direction of rotation. Consequently, the sliding member 144 slides if a velocity difference occurs between the take-up spindle 116 and the drive roller 124, and therefore allows the wiping web 110 to be conveyed at a uniform velocity at all times.

The blade 200 is installed on the side face of the case main body 126 facing the cleaning liquid deposition device 62, through a waste liquid receptacle 72. The blade 200 is installed perpendicularly with respect to the lengthwise direction of the inkjet head 16. The blade 200 is formed in a plate shape of a material having elastic properties, such as silicone rubber, EPDM (ethylene propylene dyne monomer rubber), NBR (nitriles butadiene rubber), urethane, or the like. The material selected for the blade 200 is desirably a material which is not corroded by the cleaning liquid used. In the present embodiment, the blade 200 is made of silicone rubber and has dimensions of, for example, a thickness of 1 mm, free length of 4 mm and lap distance of 1 mm.

Moreover, the blade 200 is installed in such a manner that when the wiping web 110 is pressed against the nozzle surface 30 of the inkjet head 16 by the pressing roller 118, the blade 200 abuts against the nozzle protecting region 30B located to the lower side of the nozzle surface 30 in terms of the direction of inclination of the nozzle surface 30. In other words, the blade 200 is formed to substantially the same width as the width of the nozzle protecting region 30B located to the lower side of the nozzle surface 30, and is arranged obliquely at the same angle as the angle of inclination of the nozzle protecting region 30B.

The waste liquid receptacle 72 is a member which recovers the liquid that has been swept from the nozzle surface 30 with the blade 200, and is installed on the side face of the case main body 126 facing the cleaning liquid deposition device 62. The waste liquid receptacle 72 is formed in a hollow plate shape having an open upper end, and this open upper portion is obliquely formed correspondingly to the nozzle surface 30 of the inkjet head 16 that is the object of cleaning. The blade 200 is installed inside the waste liquid receptacle 72, is formed so as to project from the open upper end.

The liquid swept from the nozzle surface 30 with the blade 200 flows down over the blade 200 and into the waste liquid receptacle 72.

A waste liquid outlet 72A is formed in the bottom portion of the waste liquid receptacle 72, and the bottom portion of the waste liquid receptacle 72 is formed so as to be inclined toward this waste liquid outlet 72A. A waste liquid tube 204 is connected to the waste liquid outlet 72A and extends vertically downward. The liquid which flows out from the waste liquid receptacle 72 passes along the waste liquid tube 204 from the waste liquid outlet 72A and is discharged.

As shown in FIGS. 18A and 18B, the installation section 104 of the wiping unit 100 formed on the rack 102 is provided on the bottom portion thereof with a waste liquid vessel 206, which can be connected to the waste liquid tube 204. When the wiping unit 100 is installed in the installation section 104 of the rack 102, the end portion of the waste liquid tube 204 connects with the waste liquid vessel 206. The liquid which has flowed down into the waste liquid receptacle 72 passes along the waste liquid tube 204 and is discharged into the waste liquid vessel 206.

The waste liquid vessel 206 is connected to a waste liquid tank (not illustrated) through a waste liquid flow channel 208 formed in the rack 102. The liquid discharged into the waste liquid vessel 206 is recovered into the waste liquid tank through the waste liquid flow channel 208.

The wiping units 100 (100C, 100M, 100Y, 100K) are composed as described above. The wiping device 64 is composed by installing the wiping units 100C, 100M, 100Y and 100K on the rack 102.

The operation of the wiping device 64 is controlled by a controller, which is not illustrated. The controller controls the wiping operation by the wiping device 64 by controlling the driving of the elevator device, motor 194, and the like.

<Action of Wiping Device>

Next, the action of the wiping device 64 according to the present embodiment having the aforementioned composition is described.

<<Installation of Wiping Web>>

The method of installation the wiping web 110 on the wiping unit 100 is described.

The wiping web 110 is formed in a band shape having the prescribed width, and the winding cores 110A and 110B are attached respectively to either end thereof. The wiping web 110 is supplied in the form of a roll wound up onto the winding core 110A, one of the winding cores.

Firstly, the wiping unit 100 is taken out from the rack 102 and the lid 128 of the case 112 is opened. Upon opening the lid 128, the supply reel 138 which is installed on the supply spindle 114 and the take-up reel 142 which is installed on the take-up spindle 116 are exposed, and then the winding cores 110A and 110B of the wiping web 110 are installed respectively on the supply reel 138 and the take-up reel 142. The winding cores 110A and 110B of the wiping web 110 are installed on the supply reel 138 and the take-up reel 142 while the wiping web 110 is being wrapped about the first front-stage guide 160, the pressing roller 118, the first rear-stage guide 164 and the drive roller 124.

More specifically, firstly, the winding core 110A on which the wiping web 110 is wound in the form of a roll is installed on the supply reel 138.

Thereupon, the wiping web 110 is unwound by a prescribed amount from the winding core 110A, passed below the second front-stage guide 162 and the second rear-stage guide 166, and also wrapped about the upper side of the first front-stage guide 160, the pressing roller 118 and the first rear-stage guide 164. At this time, the wiping web 110 is wrapped about the first front-stage guide 160, the pressing roller 118 and the first rear-stage guide 164 while the elevator stage 170 is in the lowered state, in other words, while the first front-stage guide 160, the pressing roller 118 and the first rear-stage guide 164 are in the downwardly retracted state. Thereby, it is possible to ensure sufficient space with respect to the second front-stage guide 162 and the second front-stage guide 166, and the wiping web 110 can be easily wrapped about the first front-stage guide 160, the pressing roller 118 and the first rear-stage guide 164 by passing below the second front-stage guide 162 and the second rear-stage guide 166.

The wiping web 110 wrapped about the first front-stage guide 160, the pressing roller 118 and the first rear-stage guide 164 is further wrapped about the drive roller 124, and finally the winding core 110B on the leading end thereof is installed on the take-up reel 142. Thus, installation of the wiping web 110 is completed. Thereafter, the wiping web 110 is wound back onto the winding core 110A as necessary, thereby eliminating slack in the wiping web 110, and the lid 128 of the case 112 is then closed.

<<Setting in Rack>>

Next, the wiping unit 100 in which the wiping web 110 has been installed in set in the rack 102.

The wiping unit 100 is set in the rack 102 by vertically inserting the wiping unit 100 into the installation section 104 formed in the rack 102.

When the wiping unit 100 has been set in the installation section 104 of the rack 102, as shown in FIG. 17B, the idle gear 188 of the wiping unit 100 meshes with the drive gear 192 arranged on the installation section 72, and thus becomes rotatably drivable by the motor 194, which is coupled to the drive gear 192.

Furthermore, when the wiping unit 100 is set in the installation section 104 of the rack 102, the elevator lever 178 arranged on the elevator stage 170 engages with the pin 182 arranged on the installation section 104, and the elevator stage 170 is forcibly raised up to the prescribed position. Thereby, the first front-stage guide 160, the pressing roller 118 and the first rear-stage guide 164 are registered in the prescribed use position. By registering the first front-stage guide 160, the pressing roller 118 and the first rear-stage guide 164 in the prescribed use position, the wiping web 110 becomes wrapped about the second front-stage guide 162, which is disposed between the first front-stage guide 160 and the pressing roller 118, and furthermore the wiping web 110 also becomes wrapped about the second rear-stage guide 166, which is disposed between the pressing roller 118 and the first rear-stage guide 164. Thereby, the wiping web 110 is tautly wrapped about the circumferential surface of the pressing roller 118.

Thus, the setting of the wiping unit 100 in the rack 102 is completed.

In the thus set wiping unit 100 in the rack 102, by driving the motor 194, the wiping web 110 is supplied from the supply spindle 114 and taken up onto the take-up spindle 116 after passing along a prescribed path of travel.

Furthermore, as shown in FIG. 8, the pressing rollers 118 of the wiping units 100C, 100M, 100Y and 100K, which correspond respectively to the inkjet heads 16C, 16M, 16Y and 16K disposed with their nozzle surfaces 30C, 30M, 30Y and 30K at the inclinations with respect to the horizontal plane, are positioned in parallel with the nozzle surfaces 30C, 30M, 30Y and 30K, respectively. Thus, it is possible to cause the wiping webs 110 wrapped about the respective pressing rollers 118 to make tight contact with the corresponding nozzle surfaces 30C, 30M, 30Y and 30K.

Since each pressing roller 118 is formed with a central portion having an enlarged diameter, in accordance with the cross-sectional shape of the nozzle surface 30, then it is possible to cause the wiping web 110 to make tight contact also with the nozzle forming region 30A, which is formed in the shape recessed from the nozzle holding regions 30B.

<<Wiping Operation>>

Similarly to the cleaning liquid deposition device 62, the wiping device 64 wipes and cleans the nozzle surfaces 30 (30C, 30M, 30Y, 30K) of the inkjet heads 16 (16C, 16M, 16Y, 16K) while the inkjet heads move from the image recording position to the maintenance position. More specifically, the nozzle surfaces are wiped as follows.

The whole of the wiping device 64 is arranged raisable and lowerable. When not performing cleaning, the wiping device 64 is disposed in a prescribed standby position. During cleaning, the wiping apparatus 64 is raised by a prescribed amount from the standby position to a prescribed operating position.

When the wiping device 64 is moved to the operating position, the nozzle surfaces 30C, 30M, 30Y and 30K of the inkjet heads 16C, 16M, 16Y and 16K can be wiped by the wiping units 100C, 100M, 100Y and 100K. More specifically, when the inkjet heads 16C, 16M, 16Y and 16K pass the respective wiping units 100C, 100M, 100Y and 100K, it is possible for the wiping webs 110 wound about the pressing rollers 118 to abut and press against the nozzle surfaces 30C, 30M, 30Y and 30K.

In this case, as described above, since the central portion of each pressing roller 118 which corresponds to the nozzle forming region 30A is formed with the enlarged diameter, then it is possible to cause the wiping web 110 to make tight contact with the nozzle forming region 30A also.

Moreover, when the wiping device 64 moves to the operating position, it is possible to wipe the nozzle protecting regions 30B disposed on the lower sides of the nozzle surfaces 30 in terms of the direction of inclination of the nozzle surfaces 30, by means of the blades 200 arranged in the respective wiping units 100C, 100M, 100Y and 100K. More specifically, when the inkjet heads 16C, 16M, 16Y and 16K pass the respective wiping units 100C, 100M, 100Y and 100K, it is possible for the blades 200 to abut and press against the nozzle protecting regions 30B located on the lower side of the nozzle surfaces 30C, 30M, 30Y, 30K in the direction of inclination thereof When the inkjet heads 16C, 16M, 16Y and 16K in which the cleaning liquid has been deposited on the nozzle surfaces 30C, 30M, 30Y and 30K by the cleaning liquid deposition device 62 are moved in this state toward the maintenance position, during the course of this movement, the wiping units 100C, 100M, 100Y and 100K clean and wipe the nozzle surfaces 30C, 30M, 30Y and 30K.

In this, the nozzle protecting regions 30B located on the lower side of the nozzle surfaces 30C, 30M, 30Y and 30K in terms of the direction of inclination are firstly wiped by the blades 200, and then the whole of the nozzle surfaces are wiped by the wiping webs 110. Thus, it is possible to wipe the nozzle surfaces 30C, 30M, 30Y and 30K reliably, without impairing the absorption capability of the wiping web 110.

More specifically, since the inkjet heads 16C, 16M, 16Y and 16K are arranged with the nozzle surfaces 30C, 30M, 30Y and 30K oblique to the horizontal plane, and no liquid repelling treatment is applied to the nozzle protection regions 30B located on the lower side in the direction of inclination, then the cleaning liquid deposited by the cleaning liquid deposition device 62 in the previous stage may adhere in large quantities to the nozzle protecting regions 30B located on the lower side in the direction of inclination. Therefore, if the nozzle surfaces 30C, 30M, 30Y and 30K are wiped with the wiping webs 110 in a state where the large amount of cleaning liquid is adhering in this way, then the cleaning liquid adhering to the nozzle protecting regions 30B is absorbed by the wiping webs 110 and the absorption capability of the wiping webs 110 declines. On the other hand, in the wiping device 64 according to the present embodiment, the nozzle protecting regions 30B on the lower sides in the direction of inclination are wiped in advance by the blades 200, and therefore it is possible to remove the excess cleaning liquid prior to wiping with the wiping webs 110 and the nozzle surfaces 30C, 30M, 30Y and 30K can be wiped without imparting the wiping capability of the wiping webs 110. Furthermore, since the blades 200 are not pressed against the nozzle forming regions 30A, then it is possible to avoid the occurrence of problems such as soiled ink being pushed inside the nozzles by the blades 200, or the liquid repelling treatment surfaces being rubbed by the blades 200 and caused to wear.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 are pressed against the nozzle surfaces 30C, 30M, 30Y and 30K, thus wiping and cleaning the nozzle surfaces 30C, 30M, 30Y and 30K. Furthermore, it is also possible to perform wiping by pressing a new surface of web against each of the nozzle surfaces 30C, 30M, 30Y and 30K, at all times.

<Action of Nozzle Surface Cleaning Apparatus>

The nozzle surface cleaning apparatus 60 according to the present embodiment is composed as described above.

Next, a nozzle surface cleaning operation performed by the nozzle surface cleaning apparatus 60 in the present embodiment is described.

The cleaning of the nozzle surfaces is performed while the inkjet heads 16C, 16M, 16Y and 16K are moved from the image recording position to the maintenance position.

When a nozzle surface cleaning instruction is input to the controller, the controller moves the cleaning liquid deposition device 62 and the wiping device 64 to the prescribed operating positions. By this means, it becomes possible for the cleaning liquid deposition device 62 to deposit the cleaning liquid and for the wiping device 64 to perform wiping.

After the cleaning liquid deposition device 62 and the wiping device 64 are moved to the prescribed operating positions, the controller causes the head supporting frame 40 to move from the image recording position to the maintenance position at a prescribed movement speed.

On the other hand, the controller also drives the cleaning liquid supply pump 86 in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid flows out at a prescribed flow rate from the cleaning liquid emission ports 78 of the cleaning liquid deposition heads 74 in the respective cleaning liquid deposition units 70C, 70M, 70Y and 70K. The cleaning liquid which has flowed out from the cleaning liquid emission ports 78 flows down over the cleaning liquid holding surfaces 74A.

When the inkjet heads 16C, 16M, 16Y and 16K moving toward the maintenance position pass the cleaning liquid deposition heads 74, the cleaning liquid which has flowed over the cleaning liquid holding surfaces 74A of the cleaning liquid deposition heads 74 contacts the nozzle surfaces 30C, 30M, 30Y and 30K, and the cleaning liquid is thereby deposited on the nozzle surfaces 30C, 30M, 30Y and 30K.

The nozzle surfaces 30C, 30M, 30Y and 30K on which the cleaning liquid has been deposited are moved in this state toward the maintenance position. In passing the wiping units 100C, 100M, 100Y and 100K, the nozzle surfaces 30C, 30M, 30Y and 30K are cleaned by wiping.

In this case, firstly, the blades 200 are pressed against the nozzle protecting regions 30B which are located to the lower sides in the direction of inclination, and the excess liquid (cleaning liquid, ink, etc.) adhering to the nozzle protecting regions 30B on the lower sides is swept with the blades 200. Thereupon, the wiping webs 110 are pressed against the whole surface of each of the nozzle surfaces 30C, 30M, 30Y and 30K of the inkjet heads 16C, 16M, 16Y and 16K, and the whole of each surface is thereby wiped and cleaned.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 are pressed against the nozzle surfaces 30C, 30M, 30Y and 30K, thus wiping and cleaning the nozzle surfaces 30C, 30M, 30Y and 30K.

When the nozzle surfaces 30C, 30M, 30Y and 30K have completely passed the cleaning liquid deposition units 70C, 70M, 70Y and 70K, the driving of the cleaning liquid supply pump 86 is halted and the supply of cleaning liquid is halted.

Thereupon, the cleaning liquid deposition device 62 is withdrawn to the standby position.

When the nozzle surfaces 30C, 30M, 30Y and 30K have completely passed the wiping units 100C, 100M, 100Y and 100K, the driving of the motors 194 is halted and the travel of the wiping webs 110 is halted. Thereupon, the wiping device 64 is withdrawn to the standby position.

The cleaning of the nozzle surfaces 30C, 30M, 30Y and 30K of the inkjet heads 16C, 16M, 16Y and 16K is completed by the series of steps described above.

As described above, in the nozzle surface cleaning apparatus 60 according to the present embodiment, when wiping the nozzle surfaces 30C, 30M, 30Y and 30K with the wiping webs 110, the liquid which has adhered to the nozzle protecting regions 30B located on the lower sides in the direction of inclination is previously swept with the blades 200, whereupon the nozzle surfaces 30C, 30M, 30Y and 30K are wiped by the wiping webs 110. Thus, it is possible to prevent the wiping capability of the wiping webs 110 declining with the wiping step in the latter stage and giving rise to insufficient wiping. Furthermore, since the blades 200 wipe only the nozzle protecting regions 30B on the lower sides in the direction of inclination, and the blades 200 do not wipe the nozzle forming regions 30A, then the blades 200 never press the soiled ink into the nozzles. Consequently, it is not necessary to carry out preliminary ejection. Furthermore, since the liquid repelling treatment surfaces are not rubbed and worn by the blades 200, then it is possible to extend the lifespan of the heads.

Other Embodiments

In the embodiments described above, the composition is adopted in which the liquid adhering to the nozzle protecting regions 30B is swept with the blades 200; however, the device for sweeping the liquid adhering to the nozzle protecting regions 30B is not limited to this. Besides this, it is also possible to press a roller against the nozzle protecting regions 30B so as to sweep the excess liquid.

In the embodiments described above, an extremely fine knitted or woven wiping web 110 made of PET is used, but the composition of the wiping web is not limited to this. It is also possible to use wiping webs having other compositions, provided that they have absorbency. By using a wiping web made of extremely fine knitted or woven material, it is possible to remove adhering material effectively by the undulation of the web surface. Furthermore, by using a wiping web having absorbency as in the present embodiment, it is possible to draw out the cleaning liquid that has entered into the nozzles or ink of increased viscosity on the mouths of the nozzle apertures from the nozzle apertures.

Moreover, although there are no particular restrictions on the direction of travel of the wiping web 110 with respect to the nozzle surface 30 (the direction of travel at the position where the web makes contact with the nozzle surface 30), it is more desirable to cause the web to travel in the opposite direction to the direction of travel of the nozzle surface 30 (the direction of movement of the inkjet head).

In the embodiments described above, the composition is adopted in which the inkjet heads are moved and the cleaning liquid is deposited onto the nozzle surfaces 30 of the moving heads, but it is also possible to adopt a composition in which the cleaning liquid is deposited onto the nozzle surfaces 30 of by moving the cleaning liquid deposition device 62 without moving the inkjet heads. Moreover, it is also possible to adopt a composition in which the cleaning liquid is deposited onto the nozzle surfaces 30 by moving both the inkjet heads 16 and the cleaning liquid deposition device 62. Similarly, it is also possible to wipe the nozzle surfaces 30 by moving the wiping device 64 without moving the inkjet heads. Furthermore, it is also possible to adopt a composition in which the nozzle surfaces 30 are wiped by moving both the inkjet heads 16 and the cleaning liquid deposition device 64.

In the embodiments described above, the composition is adopted in which the blade that removes excess liquid on the nozzle surface is installed on the case main body of the wiping unit, but it is also possible to compose the blade separately from the wiping unit. More specifically, the blade should be capable of wiping the nozzle surface 30 before the wiping web 110 wipes the nozzle surface 30, and therefore it is sufficient that the blade is disposed in a position before the wiping unit (a position where the blade can wipe the nozzle surface 30 before the wiping web 110 wipes the nozzle surface 30).

In the embodiments described above, the nozzle surfaces are cleaned in the process of moving the inkjet heads 16 from the image recording position to the maintenance position, but it is also possible to adopt a composition in which the nozzle surfaces are cleaned in the process of moving the inkjet heads 16 from the maintenance position to the image recording position. In this case, the cleaning liquid deposition device 62 is disposed to the maintenance position side of the wiping device 64. Furthermore, the blades are disposed toward the side of the cleaning liquid deposition device with respect to the abutment position of the wiping webs 110.

In the embodiments described above, the cleaning liquid is deposited on the nozzle surfaces by the cleaning liquid deposition device 62, but the composition for depositing the cleaning liquid onto the nozzle surfaces (the composition for wetting the nozzle surfaces) is not limited to this. For example, it is also possible to adopt various methods, such as a method of deposition by spraying, a method of deposition by roller application, a method of depositing cleaning liquid in the form of a mist directed toward the nozzle surfaces, or the like. Moreover, it is also possible to place a cap on the nozzle surface and wet the nozzle surface by suctioning. Furthermore, a composition can be adopted in which wiping is performed by a wiping web, without depositing cleaning liquid.

The embodiments described above relate to the case of cleaning the inclined nozzle surface, but the application of the present invention is not limited to this. It can also be applied similarly to a case of cleaning a horizontal nozzle surface. In this case, a composition is adopted in which the nozzle protecting regions 30B situated on either side of the nozzle forming region 30A are wiped with blades. More specifically, a pair of blades are arranged so as to abut and press against both of the nozzle protecting regions 30B, and the liquid adhering to the nozzle protecting regions 30B is swept with the pair of blades. In a composition where a nozzle protecting region 30B is arranged on only one side, a blade is arranged so as to abut and press against the nozzle protecting region 30B on that one side. The embodiments described above related to the case where the nozzle forming region 30A is formed in the withdrawn recessed shape, but the nozzle forming region 30A may also be formed to the same height as the nozzle protection regions 30B. In other words, the nozzle surface may be formed in a flat shape.

The embodiments described above relate to the case where the liquid repelling treatment is applied only on the nozzle forming region 30A, but it is also possible to apply the liquid repelling treatment on the nozzle protecting regions 30B as well.

The embodiments described above relate to the case of cleaning the head in which the nozzles N are arranged in the two-dimensional matrix configuration in the nozzle forming region 30A (a so-called matrix head), but the arrangement of the nozzles N is not limited to this. For example, the present invention can also be used similarly in a case of cleaning a normal head in which nozzles are arranged in a single straight row in the nozzle forming region 30A.

Furthermore, in the embodiments described above, the case is described in which the present invention is applied to the inkjet recording apparatus which records images on cut sheets of paper, but the application of the present invention is not limited to this. The present invention can be applied similarly to any droplet ejection apparatus which has a nozzle surface cleaning apparatus that cleans a nozzle surface by wiping with a wiping member having absorbency, and similar actions and beneficial effects can be achieved in this case.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection apparatus, comprising:

a droplet ejection head which includes a nozzle surface having a non-nozzle forming region and a nozzle forming region of a prescribed width in a prescribed direction, a nozzle row being formed in the nozzle forming region; and a nozzle surface cleaning apparatus which cleans the nozzle surface of the droplet ejection head, the nozzle surface cleaning apparatus including:

a wiping device which presses a wiping member having absorbency against the nozzle surface and wipes the nozzle surface with the wiping member by moving the wiping member relatively in the prescribed direction with respect to the nozzle surface; and a sweeping device which sweeps excess liquid from the non-nozzle forming region before the wiping member wipes the nozzle surface, by pressing a sweeping member having elasticity against the non-nozzle forming region and moving the sweeping member relatively in the prescribed direction with respect to the nozzle surface, wherein the sweeping member is formed to have substantially the same width as the width of a nozzle protecting region.

2. The droplet ejection apparatus as defined in claim 1, wherein the nozzle surface is applied with a liquid repelling treatment only on the nozzle forming region.

3. The droplet ejection apparatus as defined in claim 1, wherein the nozzle forming region of the nozzle surface is formed in a recessed shape with respect to the non-nozzle forming region.

4. The droplet ejection apparatus as defined in claim 3, wherein a region of the wiping member corresponding to the nozzle forming region is formed in a projecting shape in accordance with a cross-sectional shape of the nozzle surface.

5. The droplet ejection apparatus as defined in claim 1, wherein:

the nozzle surface of the droplet ejection head is inclined with respect to a horizontal plane;

the non-nozzle forming region is disposed to a lower side of the nozzle surface in terms of a direction of inclination of the nozzle surface; and the sweeping device presses the sweeping member against the non-nozzle forming region disposed to the lower side of the nozzle surface.

6. The droplet ejection apparatus as defined in claim 1, wherein the wiping device includes:

a wiping device main body;

a supply spindle which is arranged on the wiping device main body;

a take-up spindle which is arranged on the wiping device main body;

a rotation drive device which drives the take-up spindle to rotate;

the wiping member which is band-shaped and wound in a form of a roll installed on the supply spindle, the wiping member traveling along a prescribed path of travel from the supply spindle and being taken up onto the take-up spindle; and a pressing roller which is arranged on the wiping device main body, the wiping member being wrapped about a circumferential surface of the pressing roller, wherein the wiping device presses the wiping member being wrapped about the circumferential surface of the pressing roller against the nozzle surface.

7. The droplet ejection apparatus as defined in claim 6, wherein the sweeping device includes:

the sweeping member which is arranged on the wiping device main body of the wiping device;

a flow channel which is arranged in the wiping device main body of the wiping device and recovers the liquid swept with the sweeping member; and a waste liquid tank into which the liquid flowing in the flow channel is discarded.

8. The droplet ejection apparatus as defined in claim 1, wherein:

the droplet ejection head includes a line head having a length corresponding to a width of a medium;

the nozzle forming region having the prescribed width is arranged along a lengthwise direction of the line head; and the nozzle row is aligned in the lengthwise direction.

9. The droplet ejection apparatus as defined in claim 8, wherein:

the droplet ejection head is arranged movably in the lengthwise direction; and the excess liquid adhering to the non-nozzle forming region is swept with the sweeping member and the nozzle surface is wiped with the wiping member, by moving the droplet ejection head.

10. The droplet ejection apparatus as defined in claim 1, further comprising a cleaning liquid deposition device which deposits cleaning liquid onto the nozzle surface while moving relatively in the prescribed direction with respect to the nozzle surface.

11. The droplet ejection apparatus as defined in claim 1, wherein said nozzle protecting region is the non-nozzle forming region.

* * * * *